US006762404B2

(12) United States Patent
Bateman et al.

(10) Patent No.: US 6,762,404 B2
(45) Date of Patent: Jul. 13, 2004

(54) MASS SPECTROMETER

(75) Inventors: Robert Harold Bateman, Knutsford (GB); Kevin Giles, Altrincham (GB); Steve Pringle, Darwen (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/178,347

(22) Filed: Jun. 25, 2002

(65) Prior Publication Data

US 2003/0001085 A1 Jan. 2, 2003

Related U.S. Application Data

(60) Provisional application No. 60/364,597, filed on Mar. 18, 2002.

(30) Foreign Application Priority Data

| | | |
|---|---|---|
| Jun. 25, 2001 | (GB) | 0115429 |
| Aug. 17, 2001 | (GB) | 0120096 |
| Aug. 17, 2001 | (GB) | 0120122 |
| Mar. 15, 2002 | (GB) | 0206164 |

(51) Int. Cl.[7] ..... H01J 49/00
(52) U.S. Cl. ..... 250/281; 250/287; 250/282
(58) Field of Search ..... 250/281, 287, 250/282, 292

(56) References Cited

U.S. PATENT DOCUMENTS

| | | | | |
|---|---|---|---|---|
| 5,206,506 A | | 4/1993 | Kirchner | |
| 5,572,035 A | | 11/1996 | Franzen | |
| 5,811,800 A | | 9/1998 | Franzen et al. | |
| 5,818,055 A | | 10/1998 | Franzen | |
| 5,847,386 A | | 12/1998 | Thomson et al. | |
| 5,905,258 A | | 5/1999 | Clemmer et al. | |
| 6,087,658 A | * | 7/2000 | Kawato | 250/292 |
| 6,107,628 A | | 8/2000 | Smith et al. | |
| 6,417,511 B1 | | 7/2002 | Russ, IV et al. | |
| 6,489,610 B1 | * | 12/2002 | Barofsky et al. | 250/287 |
| 6,545,268 B1 | | 4/2003 | Verentchikov et al. | |
| 6,559,444 B2 | | 5/2003 | Franzen | |
| 2002/0063207 A1 | | 5/2002 | Bateman et al. | |
| 2002/0063209 A1 | | 5/2002 | Bateman et al. | |
| 2002/0063210 A1 | | 5/2002 | Bateman et al. | |
| 2002/0079443 A1 | | 6/2002 | Krutchinsky et al. | |
| 2002/0113207 A1 | | 8/2002 | Lee et al. | |
| 2002/0148959 A1 | | 10/2002 | Weiss et al. | |

FOREIGN PATENT DOCUMENTS

| | | |
|---|---|---|
| CA | 2281405 | 3/2000 |
| EP | 1271138 | 1/2003 |
| GB | 2315364 | 1/1998 |
| GB | 2375653 | 11/2002 |
| JP | 11-307040 | 11/1999 |
| JP | 2000-113852 | 4/2000 |
| JP | 2000-123780 | 4/2000 |
| WO | WO 97/49111 | 12/1997 |
| WO | WO 02/43105 | 5/2002 |

OTHER PUBLICATIONS

Fuhrer et al. "Mobility Spectrometer", pub. No.: US 2002/0032929 A1, Oct. 25, 2001.*

Wang et al. "Apparatus and Methods for Analyzing Samples in a Dual Ion Trap Mass Spectrometer", publication No.: US 2002/0121594 A1, Sep. 5, 2002.*

Franzen et al., "Electrical Ion Guides" ASMS Book of Abstracts, pp. 1170, 1996.

Shaffer et al., "A Novel Ion Funnel for Ion Focusing at Elevated Pressures", ASMS Book of Abstracts, pp. 375, 1997.

(List continued on next page.)

*Primary Examiner*—Nikita Wells
*Assistant Examiner*—Zia R. Hashmi
(74) *Attorney, Agent, or Firm*—Diederiks & Whielaw, PLC

(57) ABSTRACT

A mass spectrometer includes a fragmentation cell having a plurality of ring or plate-like electrodes with apertures through which ions are transmitted. An axial DC gradient is preferably maintained along at least a portion of the length of the fragmentation cell in order to improve the transit time of ions through the device.

40 Claims, 12 Drawing Sheets-

OTHER PUBLICATIONS

Gerlich, "Rf Ion Guides", Encyclopedia of Mass Spectrometry, vol. 5, Chemistry and Physics of Gas Phase Ions, pp. 1–34, 2003.

Luca et al., "On the Combination of a Linear Field Free Trap With a Time–of–Flight Mass Spectrometer", Review of Scientific Instruments, vol. 72, No. 7, pp. 2900–2908, 2001.

Shaffer et al., "A Novel Ion Funnel for Focusing Ions at Elevated Pressure Using Electrospray Ionization Mass Spectrometry", Rapid Communications in Mass Spectrometry, vol. 11, pp. 1813–1817, 1997.

Teloy et al., "Integral Cross Sections For Ion–Molecule Reactions. I. The Guided Beam Technique", Chemical Physics, pp. 417–427, 1974.

Guan et al., "Stacked–Ring Electrostatic Ion Guide", Journal American Society for Mass Spectometry, vol. 7, pp. 101–106, 1996.

Gerlich et al., "Ion Trap Studies of Association Processes in Collisions of $CH_3^+$ and $CD_3^+$ With n–$H_2$, p–$H_2$, $D_2$, and He at 80 K", The Astrophysical Journal, vol. 347, pp. 849–854, 1989.

Kim et al., "Design and Implementation of a New Electrodynamic Ion Funnel", Analytical Chemistry, vol. 72, No. 10, pp 2247–2255, 2000.

Tolmachev et al., "Charge Capacity Limitations of Radio Frequency Ion Guides in Their Use for Improved Ion Accumulation and Trapping in Mass Spectrometry", Analytical Chemistry, vol. 72, No. 5, pp. 970–978, 2000.

Shaffer et al., "Characterization of an Improved Electrodynamic Ion Funnel Interface for Electrospray Ionization Mass Spectrometry", Analytical Chemistry, vol. 71, No. 15, pp. 2957–2964, 1999.

Shaffer et al., "An Ion Funnel Interface for Improved Ion Focusing and Sensitivity Using Electrospray Ionization Mass Spectrometry", Analytical Chemistry, vol. 70, No. 19, pp. 4111–4119, 1998.

Giles et al., "Evaluation of a Stacked–Ring Radio Frequency Ion Transmission Device at Intermediate Pressures", ASMS, 2001.

Gerlich, "Inhomogeneous RF Fields: A Versatile Tool for the Study of Processes with Slow Ions", Advances in Chemical Physics Series, vol. 82, pp. 1–176, 1992.

* cited by examiner

MASS SPECTROMETER

CROSS-REFERENCE TO RELATED APPLICATIONS

This application claims the benefit of U.S. Provisional Application Serial No. 60/364,597 filed Mar. 18, 2002.

BACKGROUND OF THE INVENTION

The present invention relates to mass spectrometers.

In many tandem mass spectrometers ions are fragmented in a collision or fragmentation cell. A known fragmentation cell comprises a multipole (e.g. a quadrupole or hexapole) rod set wherein adjacent rods are connected to opposite phases of an RF voltage supply. The quadrupole or hexapole collision cell is housed in a cylindrical housing which is open at an upstream end and at a downstream end to allow ions to enter and exit the collision cell. The housing includes a gas inlet port through which a collision or buffer gas, typically nitrogen or argon, is introduced into the collision cell. The collision cell is maintained at a pressure of $10^{-3}$–$10^{-2}$ mbar.

Ions entering the collision cell are arranged to be sufficiently energetic so that when they collide with the collision or buffer gas at least some of the ions will fragment into daughter or fragment ions by means of Collisional Induced Dissociation/Decomposition ("CID"). Ions in the collision cell will also become thermalised after they have undergone a few collisions i.e. their kinetic energy will be considerably reduced, and this leads to greater radial confinement of the ions in the presence of the RF electric field. In order to ensure that ions are sufficiently energetic so as to fragment when entering the collision cell, the collision cell is typically maintained at a DC potential which is offset from that of the ion source by approximately −30V DC or more (for positive ions). Once ions have fragmented and have been thermalised within the collision cell, their low kinetic energy is such that they will tend to remain within the collision cell. In practice, ions are observed to exit the collision cell after a relatively long period of time, and this is believed to be due to the effects of diffusion and the repulsive effect of further ions being admitted into the collision cell.

Accordingly, one of the problems associated with the known collision cell is that ions tend to have a relatively long residence time within the collision cell. This is problematic for certain types of mass spectrometry methods since it is necessary to wait until ions have exited the collision cell before further ions are admitted into it. For example, in MS/MS (i.e. fragmentation) modes of operation if a quadrupole mass filter Q1 (MS1) upstream of a collision cell Q2 is scanned rapidly compared to the typical empty time (~30 ms) of ions to exit the collision cell Q2, then the peaks in the resulting parent ion scanning mass spectrum will suffer from peak tailing towards higher mass and thus the resulting mass spectrum will suffer from relatively poor resolution. An example of this is shown in FIG. 16(*a*).

Similarly, in Multiple Reaction Monitoring (MRM) experiments the upstream quadrupole mass filter Q1 (MS1) is switched rapidly to cyclically transmit a number of parent ions (e.g. P1, P2 . . . Pn) in a multiplexed manner, and the long empty times of ions to exit the collision cell Q2 may result in cross-talk between the various channels.

Long empty times of ions to exit the collision cell Q2 is also problematic when the mass spectrometer is being used in on-line chromatography applications since each peak only elutes over a short period of time and the mass spectrometer will have to acquire data very rapidly if a full parent (precursor) ion spectrum is desired.

It is therefore desired to provide an improved collision or fragmentation cell for use in a mass spectrometer which does not suffer from some or all of the problems discussed above.

SUMMARY OF THE INVENTION

According to a first aspect of the present invention, there is provided a mass spectrometer comprising: a fragmentation cell in which ions are fragmented in use, the fragmentation cell comprising a plurality of electrodes having apertures through which ions are transmitted in use, wherein at least some of the electrodes are connected to both a DC and an AC or RF voltage supply and wherein an axial DC voltage gradient or difference is maintained in use along at least a portion of the length of the fragmentation cell.

The preferred collision or fragmentation cell differs from a conventional multipole collision cell in that instead of comprising four or six elongated rod electrodes, the fragmentation cell comprises a number (e.g. typically >100) of ring, annular or plate like electrodes having apertures, preferably circular, through which ions are transmitted. Furthermore, an axial DC voltage gradient is preferably maintained across at least a portion of the length of the fragmentation cell, preferably the whole length of the fragmentation cell.

The fragmentation cell according to the preferred embodiment is capable of being emptied of and filled with ions much faster than a conventional collision cell. Mass spectra obtained using the preferred fragmentation cell exhibit improved resolution and greater sensitivity.

The fragmentation cell may comprise 10–20, 20–30, 30–40, 40–50, 50–60, 60–70, 70–80, 80–90, 90–100, 100–110, 110–120, 120–130, 130–140, 140–150, or >150 electrodes. The fragmentation cell may have a length <5 cm, 5–10 cm, 10–15 cm, 15–20 cm, 20–25 cm, 25–30 cm, or >30 cm. Preferably, at least 10%, 20%, 30%, 40%, 50%, 60%, 70%, 80%, 90%, or 95% of the electrodes are connected to both a DC and an AC or RF voltage supply. According to a one embodiment, an axial DC voltage difference of approximately 3V may be maintained along the whole length of the fragmentation cell (i.e. for positive ions, electrodes at the downstream end of the fragmentation cell are maintained at a DC voltage approximately 3V below electrodes at the upstream end of the fragmentation cell). In other embodiments the axial DC voltage difference maintained along at least a portion, preferably the whole length, of the fragmentation cell is 0.1–0.5 V, 0.5–1.0 V, 1.0–1.5 V, 1.5–2.0 V, 2.0–2.5 V, 2.5–3.0 V, 3.0–3.5 V, 3.5–4.0 V, 4.0–4.5 V, 4.5–5.0 V, 5.0–5.5 V, 5.5–6.0 V, 6.0–6.5 V, 6.5–7.0 V, 7.0–7.5 V, 7.5–8.0 V, 8.0–8.5 V, 8.5–9.0 V, 9.0–9.5 V, 9.5–10.0 V or >10V.

In terms of V/cm, the axial DC voltage gradient maintained along at least a portion of the fragmentation cell, and preferably along the whole length of the collision cell, may be 0.01–0.05 V/cm, 0.05–0.10 V/cm, 0.10–0.15 V/cm, 0.15–0.20 V/cm, 0.20–0.25 V/cm, 0.25–0.30 V/cm, 0.30–0.35 V/cm, 0.35–0.40 V/cm, 0.40–0.45 V/cm, 0.45–0.50 V/cm, 0.50–0.60 V/cm, 0.60–0.70 V/cm, 0.70–0.80 V/cm, 0.80–0.90 V/cm, 0.90–1.0 V/cm, 1.0–1.5 V/cm, 1.5–2.0 V/cm, 2.0–2.5 V/cm, 2.5–3.0 V/cm or >3.0 V/cm.

The voltage gradient may be a linear voltage gradient, or the voltage gradient may have a stepped or curved stepped profile similar to that shown in FIG. 4. The term "voltage gradient" should be construed broadly to cover embodiments wherein the DC voltage offset of electrodes along the length of the fragmentation cell relative to the DC potential of the ion source varies at different points along the length of the fragmentation cell. This term should not, however, be construed to include arrangements wherein all the electrodes forming the fragmentation cell are maintained at substantially the same DC potential.

According to the preferred embodiment, the electrodes forming the fragmentation cell are supplied with an AC or RF voltage which can be considered to be superimposed upon the DC potential supplied to the electrodes. Preferably, adjacent electrodes are connected to opposite phases of an AC or RF supply but according to other less preferred embodiments adjacent electrodes may be connected to different phases of the AC or RF supply i.e. voltage supplies having more than two phases are contemplated. Furthermore, although according to the preferred embodiment the AC or RF voltage supplied to the electrodes has a sinusoidal waveform (with a frequency 0.1–3.0 MHz, preferably 1.75 MHz), non-sinusoidal waveforms including square waves may be supplied to the electrodes.

According to a particularly preferred embodiment, the fragmentation cell may comprise a plurality of segments. In one embodiment fifteen segments are provided. Each segment comprises a plurality of electrodes, with preferably either eight or ten electrodes per segment. Each electrode has an aperture through which ions are transmitted. The diameter of the apertures of at least 50% of the electrodes forming the fragmentation cell is preferably $\leqq 10$ mm, $\leqq 9$ mm, $\leqq 8$ mm, $\leqq 7$ mm, $\leqq 6$ mm, $\leqq 5$ mm, $\leqq 4$ mm, $\leqq 3$ mm, $\leqq 2$ mm, or $\leqq 1$ mm. The thickness of at least 50% of the electrodes forming the fragmentation cell is preferably $\leqq 3$ mm, $\leqq 2.5$ mm, $\leqq 2.0$ mm, $\leqq 1.5$ mm, $\leqq 1.0$ mm, or $\leqq 0.5$ mm. Preferably, at least 50%, 60%, 70%, 80%, 90% or 95% of the electrodes forming the fragmentation cell have apertures which are substantially the same size or area. All the electrodes in a particular segment are preferably maintained at substantially the same DC potential, but adjacent electrodes in a segment are preferably supplied with different or opposite phases of an AC or RF voltage.

In an embodiment, ions may be trapped within the fragmentation cell in a mode of operation. Embodiments are contemplated wherein ions may be trapped in a downstream portion of the fragmentation cell whilst ions may be continually admitted into an upstream portion of the fragmentation cell. V-shaped axial DC potential profiles may be used to accelerate and trap ions within the collision cell.

The fragmentation cell is preferably maintained, in use, at a pressure $>1.0\times10^{-3}$ mbar, $>5.0\times10^{-3}$ mbar, $>1.0\times10^{-2}$ mbar $10^{-3}$–$10^{-2}$ mbar, or $10^{-4}$–$10^{-1}$ mbar.

The mass spectrometer preferably comprises a continuous ion source, further preferably an atmospheric pressure ion source, although other ion sources are contemplated. Electrospray ("ESI"), Atmospheric Pressure Chemical Ionisation ("APCI"), Atmospheric Pressure Photo Ionisation ("APPI"), Matrix Assisted Laser Desorption Ionisation ("MALDI"), non-matrix assisted Laser Desorption Ionisation, Inductively Coupled Plasma ("ICP"), Electron Impact ("EI") and Chemical Ionisation ("CI") ion sources may be provided.

The fragmentation cell preferably comprises a housing having an upstream opening for allowing ions to enter the fragmentation cell and a downstream opening for allowing ions to exit the fragmentation cell.

According to a second aspect of the present invention, there is provided a mass spectrometer comprising: an ion source; one or more ion guides; a first quadrupole mass filter; a fragmentation cell for fragmenting ions, the fragmentation cell comprising a plurality of electrodes having apertures through which ions are transmitted in use, wherein at least some of the electrodes are connected to both a DC and an AC or RF voltage supply and wherein an axial DC voltage gradient or difference is maintained in use along at least a portion of the length of the fragmentation cell; a second quadrupole mass filter; and a detector.

According to a third aspect of the present invention, there is provided a mass spectrometer comprising: an ion source; one or more ion guides; a quadrupole mass filter; a fragmentation cell for fragmenting ions, the fragmentation cell comprising a plurality of electrodes having apertures through which ions are transmitted in use, wherein at least some of the electrodes are connected to both a DC and an AC or RF voltage supply and wherein an axial DC voltage gradient or difference is maintained in use along at least a portion of the length of the fragmentation cell; and a time of flight mass analyser.

Preferably, the fragmentation cell comprises a plurality of segments, each segment comprising a plurality of electrodes having apertures through which ions are transmitted and wherein all the electrodes in a segment are maintained at substantially the same DC potential and wherein adjacent electrodes are supplied with different phases of an AC or RF voltage.

The one or more ion guides may comprise one or more AC or RF only ion tunnel ion guides (wherein at least 90% of the electrodes have apertures which are substantially the same size) and/or one or more hexapole ion guides.

According to a fourth aspect of the present invention, there is provided a mass spectrometer comprising: a first mass filter/analyser; a fragmentation cell for fragmenting ions, the fragmentation cell being arranged downstream of the first mass filter/analyser and comprising at least 20 electrodes having apertures through which ions are transmitted in use, wherein at least 75% of the electrodes are connected to both a DC and an AC or RF voltage supply and wherein a non-zero axial DC voltage gradient or difference is maintained in use along at least 75% of the length of the fragmentation cell; and a second mass filter/analyser arranged downstream of the fragmentation cell.

Preferably, the first mass filter/analyser comprises a quadruople mass filter/analyser and the second mass filter comprises a quadrupole mass filter/analyser or a time of flight mass analyser.

According to a fifth aspect of the present invention, there is provided a mass spectrometer comprising: a fragmentation cell comprising $\geqq 10$ ring or plate electrodes having substantially similar internal apertures between 2–10 mm in diameter arranged in a housing having a buffer gas inlet port, wherein a buffer gas is introduced in use into the fragmentation cell at a pressure of $10^{-4}$–$10^{-1}$ mbar and wherein a DC potential gradient or difference is maintained, in use, along the length of the fragmentation cell.

Preferably, the mass spectrometer further comprises an ion source and ion optics upstream of the fragmentation cell, wherein the ion source and/or the ion optics are maintained at potentials such that at least some of the ions entering the fragmentation cell have, in use, an energy $\geqq 10$ eV for a singly charged ion such that they are caused to fragment.

According to a sixth aspect of the present invention, there is provided a mass spectrometer comprising: an ion source; a fragmentation cell for fragmenting ions, the fragmentation cell comprising at least ten plate-like electrodes arranged substantially perpendicular to the longitudinal axis of the fragmentation cell, each electrode having an aperture therein through which ions are transmitted in use, the fragmentation cell being supplied in use with a collision gas at a pressure $\geqq 10^{-3}$ mbar, wherein adjacent electrodes are connected to different phases of an AC or RF voltage supply and a DC potential gradient $\geqq 0.01$ V/cm is maintained over at least 20% of the length of the fragmentation cell; and ion optics arranged between the ion source and the fragmentation cell; wherein in a mode of operation the ion source, ion optics and fragmentation cell are maintained at potentials such that singly charged ions are caused to have an energy $\geqq 10$ eV upon entering the fragmentation cell so that at least some of the ions fragment into daughter ions.

According to a seventh aspect of the present invention, there is provided a mass spectrometer comprising: a collision or fragmentation cell comprising at least three segments, each segment comprising at least four electrodes having substantially similar sized apertures through which ions are transmitted in use; wherein in a mode of operation: electrodes in a first segment are maintained at substantially the same first DC potential but adjacent electrodes are supplied with different phases of an AC or RF voltage supply; electrodes in a second segment are maintained at substantially the same second DC potential but adjacent electrodes are supplied with different phases of an AC or RF voltage supply; electrodes in a third segment are maintained at substantially the same third DC potential but adjacent electrodes are supplied with different phases of an AC or RF voltage supply; wherein the first, second and third DC potentials are all different.

According to an eighth aspect of the present invention, there is provided a mass spectrometer comprising: a fragmentation cell in which ions are fragmented in use, the fragmentation cell comprising a plurality of electrodes having apertures through which ions are transmitted in use, wherein at least some of the electrodes are connected to an AC or RF voltage supply.

Preferably, at least some of the electrodes are also connected to a DC voltage supply and wherein an axial DC voltage gradient or difference is maintained in use along at least a portion of the length of the fragmentation cell.

According to a ninth aspect of the present invention, there is provided a mass spectrometer comprising: a fragmentation cell in which ions are fragmented in use, the fragmentation cell comprising a plurality of electrodes having apertures through which ions are transmitted in use, wherein in a mode of operation at least a portion of the fragmentation cell is maintained at a DC potential so as to prevent ions from exiting the fragmentation cell.

According to a tenth aspect of the present invention, there is provided a mass spectrometer comprising: a fragmentation cell in which ions are fragmented in use, the fragmentation cell comprising a plurality of electrodes having apertures through which ions are transmitted in use, wherein the empty time taken for ions to exit the fragmentation cell is selected from the group comprising: (i) $\leqq 0.5$ ms; (ii) $\leqq 1.0$ ms; (iii) $\leqq 5$ ms; (iv) $\leqq 10$ ms; (v) $\leqq 20$ ms; (vi) 0.01–0.5 ms; (vii) 0.5–1 ms; (viii) 1–5 ms; (ix) 5–10 ms; and (x) 10–20 ms.

According to an eleventh aspect of the present invention, there is provided a mass spectrometer comprising: a fragmentation cell in which ions are fragmented in use, the fragmentation cell comprising a plurality of electrodes having apertures through which ions are transmitted in use, and wherein in a mode of operation trapping DC voltages are supplied to some of the electrodes so that ions are confined in two or more axial DC potential wells.

According to a twelfth aspect of the present invention, there is provided a mass spectrometer comprising: a fragmentation cell in which ions are fragmented in use, the fragmentation cell comprising a plurality of electrodes having apertures through which ions are transmitted in use, and wherein in a mode of operation a V-shaped, sinusoidal, curved, stepped or linear axial DC potential profile is maintained along at least a portion, preferably at least 10%, 20%, 30%, 40%, 50%, 60%, 70%, 80%, 90%, or 95% of the length of the fragmentation cell.

According to a thirteenth aspect of the present invention, there is provided a mass spectrometer comprising: a fragmentation cell in which ions are fragmented in use, the fragmentation cell comprising a plurality of electrodes having apertures through which ions are transmitted in use, and wherein in a mode of operation an upstream portion of the fragmentation cell continues to receive ions into the fragmentation cell whilst a downstream portion of the fragmentation cell separated from the upstream portion by a potential barrier stores and periodically releases ions.

Preferably, the upstream portion of the fragmentation cell has a length which is at least 10%, 20%, 30%, 40%, 50%, 60%, 70%, 80%, or 90% of the total length of the fragmentation cell. Preferably, the downstream portion of the fragmentation cell has a length which is less than or equal to 10%, 20%, 30%, 40%, 50%, 60%, 70%, 80%, or 90% of the total length of the fragmentation cell. Further preferably, the downstream portion of the fragmentation cell is shorter than the upstream portion of the fragmentation cell.

According to a fourteenth aspect of the present invention, there is provided a mass spectrometer comprising: a fragmentation cell in which ions are fragmented in use, said fragmentation cell comprising a plurality of electrodes having apertures through which ions are transmitted in use, and wherein in a mode of operation an AC or RF voltage is applied to at least some of said electrodes and the peak amplitude of said AC or RF voltage is varied.

Preferably, the peak amplitude of the AC or RF voltage is increased in time.

Preferably, when ions having a mass to charge ratio <500, <400, <300, <200, <100, or <50 are admitted into the fragmentation cell the peak amplitude of the AC or RF voltage is $\geqq 200$ $V_{Pp}$, $\geqq 150$ $V_{Pp}$, $\geqq 100$ $V_{Pp}$, or $\geqq 60$ $V_{Pp}$.

Preferably, when ions having a mass to charge ratio >500, >600, >700, >800, >900, or >1000 are admitted into the fragmentation cell the peak amplitude of the AC or RF voltage is $\geqq 100$ $V_{Pp}$, $\geqq 150$ $V_{Pp}$, $\geqq 200$ $V_{Pp}$, $\geqq 250$ $V_{Pp}$, or $\geqq 300$ $V_{Pp}$.

According to a fifteenth aspect of the present invention, there is provided a method of mass spectrometry, comprising: fragmenting ions in a fragmentation cell, the fragmentation cell comprising a plurality of electrodes having apertures through which ions are transmitted in use, wherein at least some of the electrodes are connected to both a DC and an AC or RF voltage supply and wherein an axial DC voltage gradient or difference is maintained in use along at least a portion of the length of the fragmentation cell.

BRIEF DESCRIPTION OF THE DRAWINGS

Various embodiments of the present invention will now be described, by way of example only, and with reference to the accompanying drawings in which:

FIG. 1(*b*) shows another ion tunnel fragmentation cell which is additionally capable of confining ions within the fragmentation cell;

FIG. 3(*b*) shows a side view of an upper ion tunnel section;

FIG. 3(*c*) shows a plan view of an ion tunnel segment;

FIG. 7(*b*) shows a corresponding "closed" mode of operation;

FIG. 7(*c*) shows a corresponding "empty" mode of operation;

FIG. 12(*b*) shows corresponding transmission characteristics for ions having a mass charge ratios of 609;

FIG. 12(*c*) shows corresponding transmission characteristics for ions having a mass charge ratios of 1081;

FIG. 12(*d*) shows corresponding transmission characteristics for ions having a mass charge ratios of 2034;

FIG. 15(*b*) shows a neutral loss spectra of S-desmethyl metabolite formed during microsomal incubation of Rabeprazole for a fragmentation cell according to the preferred embodiment;

FIG. 16(*b*) shows a parent ion spectra of Sulphone metabolite formed during microsomal incubation of Rabeprazole for a fragmentation cell according to the preferred embodiment;

FIG. 17(*b*) shows extracted ion chromatograms of Sulphone metabolite formed during microsomal incubation of Rabeprazole for a fragmentation cell according to the preferred embodiment.

DETAILED DESCRIPTION OF THE PREFERRED EMBODIMENTS

Figure 1A:
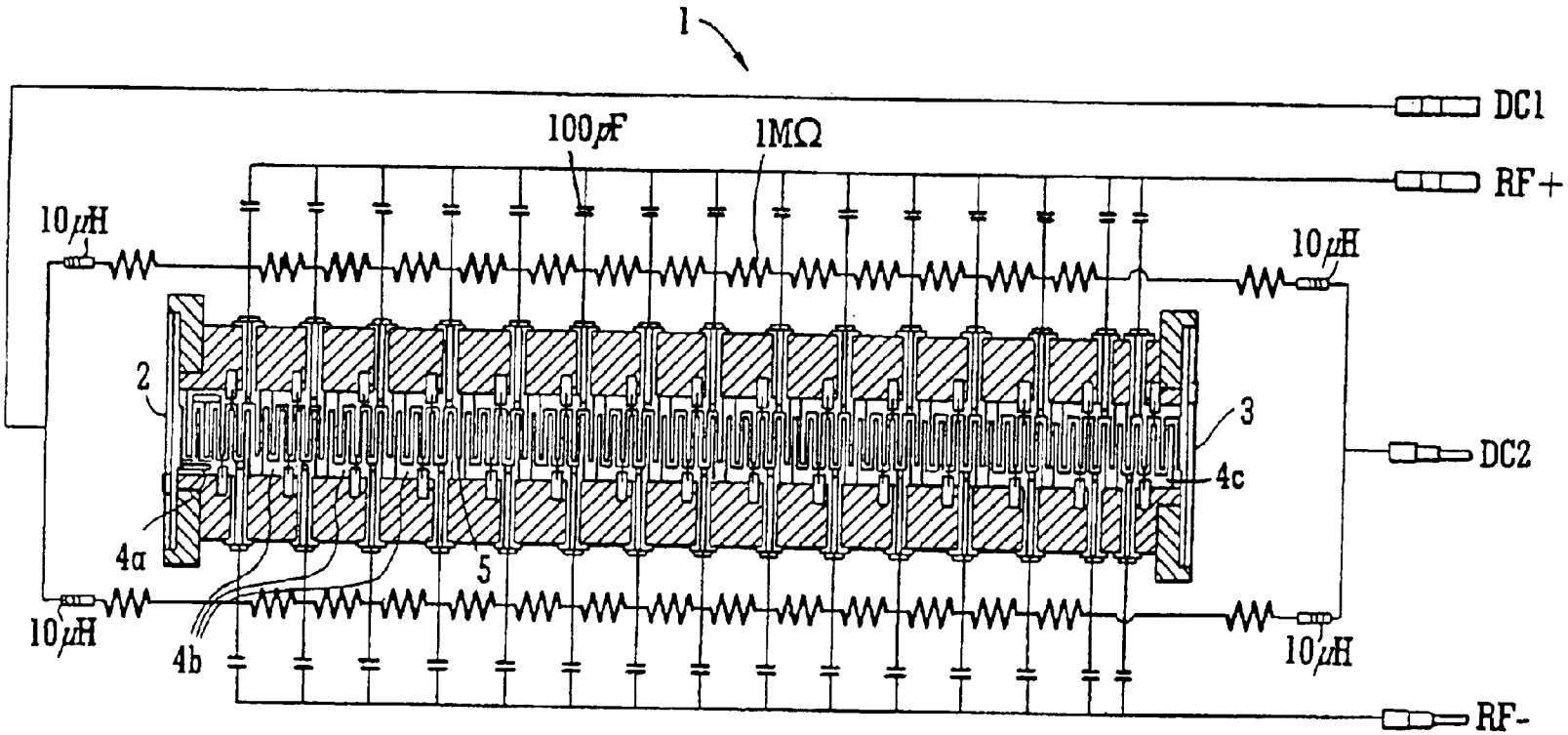
FIG. 1(*a*) shows a preferred ion tunnel fragmentation cell.

A preferred ion tunnel collision or fragmentation cell will now be described in relation to FIGS. 1 and 2. The ion tunnel fragmentation cell 1 comprises a reasonably gas tight housing having a relatively small entrance aperture 2 and a relatively small exit aperture 3. The entrance and exit apertures 2,3 are preferably 2.2 mm diameter substantially circular apertures. The plates forming the entrance and/or exit apertures 2,3 may be connected to independent programmable DC voltage supplies (not shown).

Between the plate forming the entrance aperture 2 and the plate forming the exit aperture 3 are arranged a number of electrically isolated ion tunnel segments 4*a*,4*b*,4*c*. In one embodiment fifteen segments 4*a*,4*b*,4*c* are provided. Each ion tunnel segment 4*a*;4*b*;4*c* comprises two interleaved and electrically isolated sections i.e. an upper and lower section. The ion tunnel segment 4*a* closest to the entrance aperture 2 preferably comprises ten electrodes (with five electrodes in each section) and the remaining ion tunnel segments 4*b*,4*c* preferably each comprise eight electrodes (with four electrodes in each section). All the electrodes are preferably substantially similar in that they have a central substantially circular aperture (preferably 5 mm in diameter) through which ions are transmitted. The entrance and exit apertures 2,3 are preferably smaller (e.g. 2.2 mm in diameter) than the apertures in the electrodes, and this helps to reduce the amount of collision gas leaking out of the fragmentation cell 1 into the vacuum chamber containing the fragmentation cell 1 which is preferably maintained at a lower pressure e.g. $10^{-4}$ mbar or less.

All the ion tunnel segments 4*a*,4*b*,4*c* are preferably connected to the same AC or RF voltage supply, but different segments 4*a*;4*b*;4*c* may be provided with different DC voltages. The two sections forming an ion tunnel segment 4*a*;4*b*;4*c* are connected to different, preferably opposite, phases of the AC or RF voltage supply.

Figure 3C:
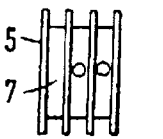
FIG. 3(*a*) shows a front view of an ion tunnel segment.
Figure 3B:
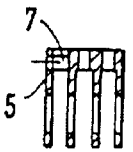
Figure 3A:
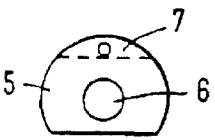

A single ion tunnel section is shown in greater detail in FIGS. 3(*a*)–(*c*). The ion tunnel section has four (or five) electrodes 5, each electrode 5 having a 5 mm diameter central aperture 6. The four (or five) electrodes 5 depend or extend from a common bar or spine 7 and are preferably truncated at the opposite end to the bar 7 as shown in FIG. 3(*a*). Each electrode 5 is typically 0.5 mm thick. Two ion tunnel sections are interlocked or interleaved to provide a total of eight (or ten) electrodes 5 in an ion tunnel segment 4*a*;4*b*;4*c* with a 1 mm inter-electrode spacing once the two sections have been interleaved. All the eight (or ten) electrodes 5 in an ion tunnel segment 4*a*;4*b*;4*c* comprised of two separate sections are preferably maintained at substantially the same DC voltage. Adjacent electrodes in an ion tunnel segment 4*a*;4*b*;4*c* comprised of two interleaved sections are connected to different, preferably opposite, phases of an AC or RF voltage supply i.e. one section of an ion tunnel segment 4*a*;4*b*;4*c* is connected to one phase (RF+) and the other section of the ion tunnel segment 4*a*;4*b*;4*c* is connected to another phase (RF−).

Each ion tunnel segment 4*a*;4*b*;4*c* is mounted on a machined PEEK support that acts as the support for the entire assembly. Individual ion tunnel sections are located and fixed to the PEEK support by means of a dowel and a screw. The screw is also used to provide the electrical connection to the ion tunnel section. The PEEK supports are held in the correct orientation by two stainless steel plates attached to the PEEK supports using screws and located correctly using dowels. These plates are electrically isolated and have a voltage applied to them.

Collision gas is supplied to the fragmentation cell 1 via a 4.5 mm ID tube. Another tube may be connected to a vacuum gauge allowing the pressure in the fragmentation cell 1 to be monitored.

Figure 1B:
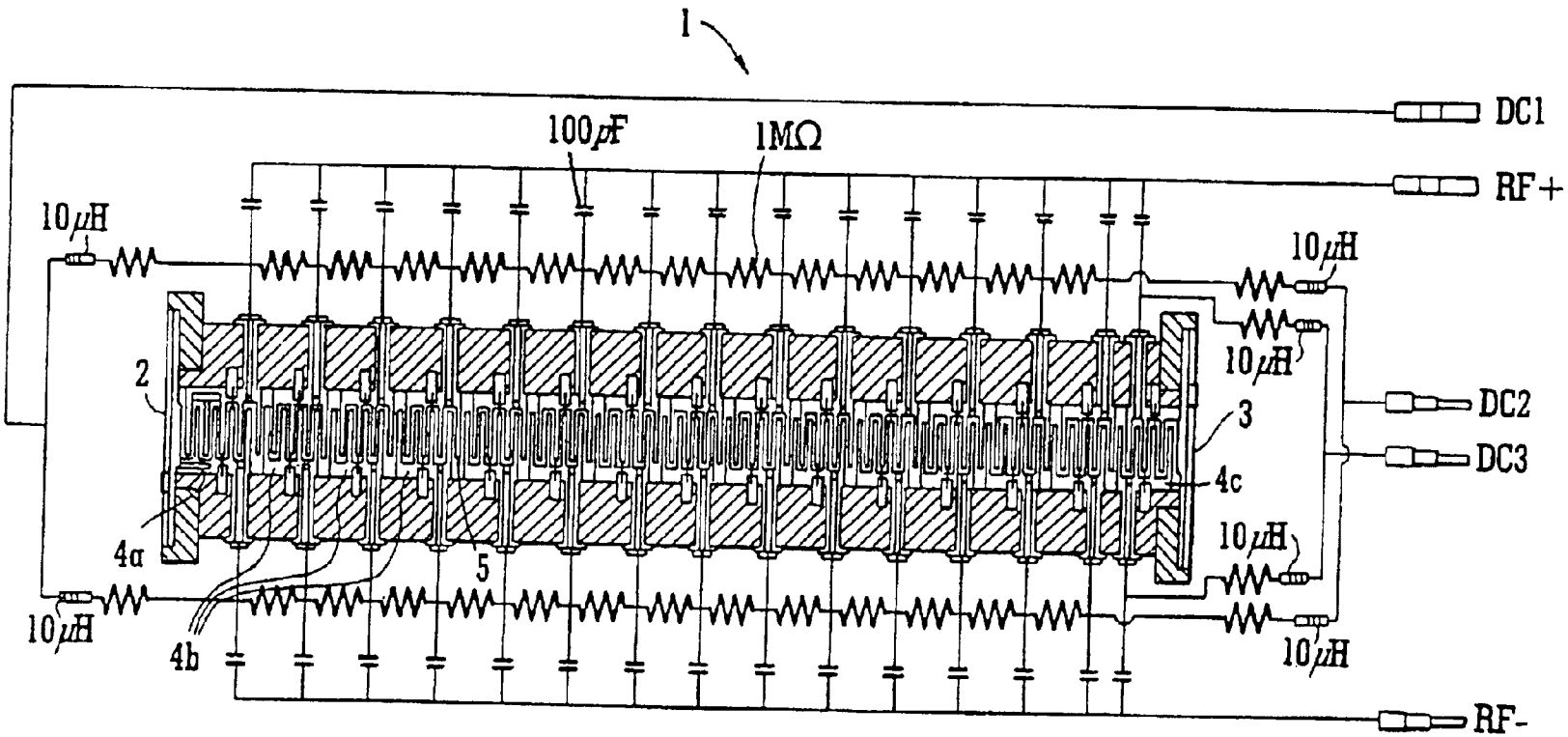
Figure 2:
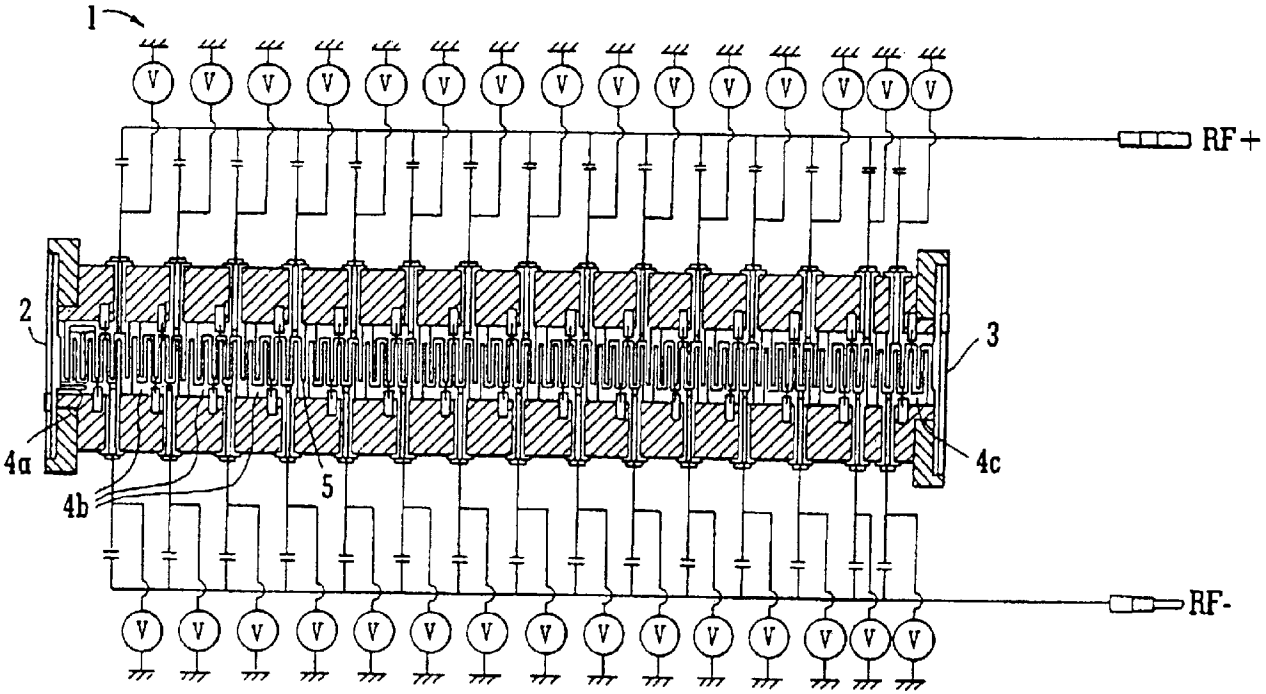
FIG. 2 shows another ion tunnel fragmentation cell wherein the DC voltage supply to each ion tunnel segment is individually controllable.
Figure 4:
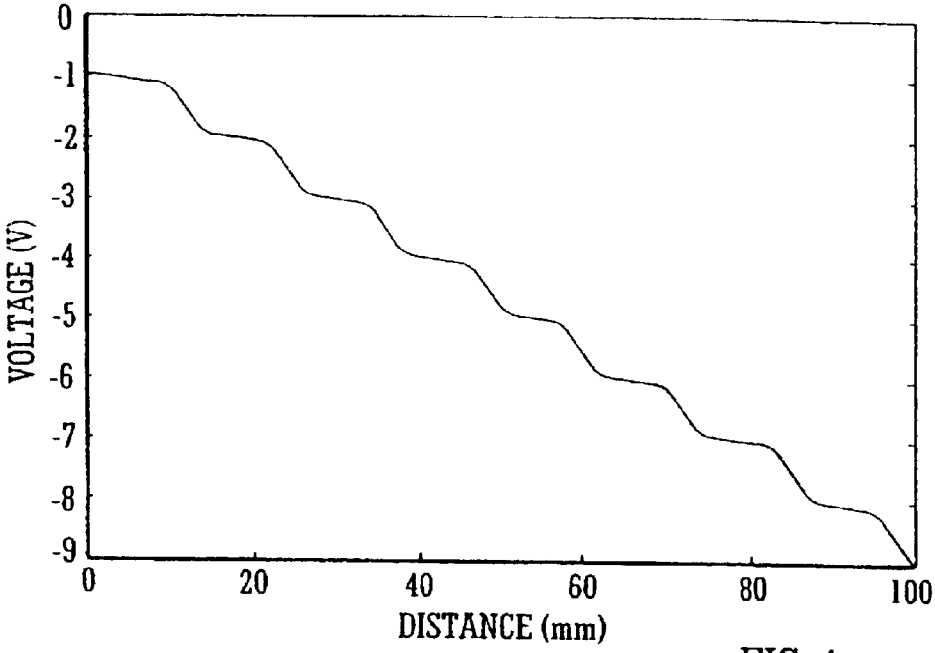
FIG. 4 shows an axial DC potential profile as a function of distance at a central portion of an ion tunnel fragmentation cell.
Figure 5:
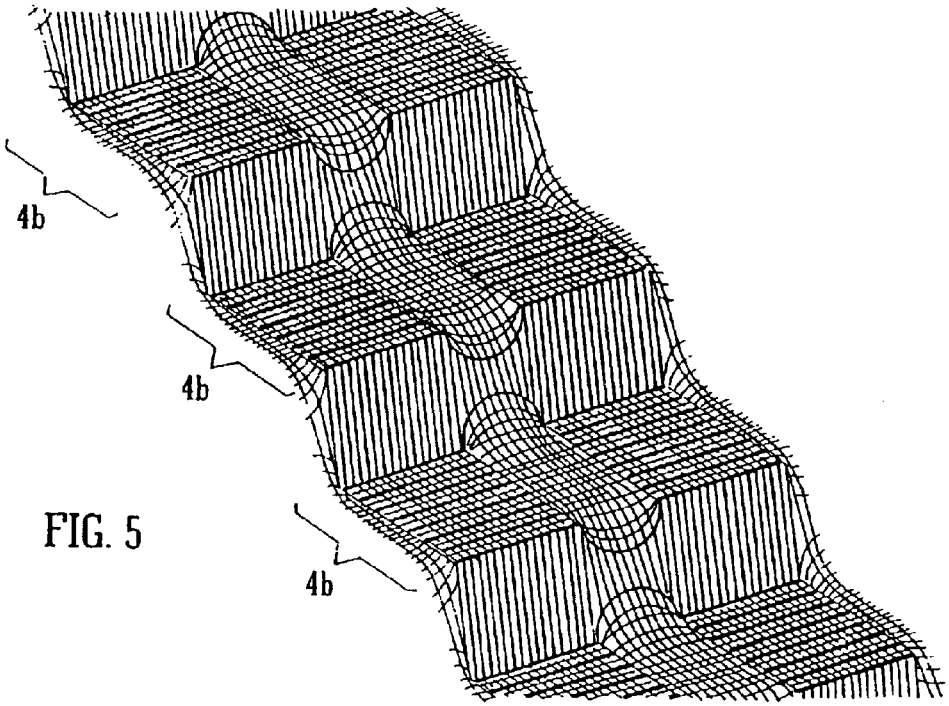
FIG. 5 shows a potential energy surface across a number of ion tunnel segments at a central portion of an ion tunnel fragmentation cell.

The electrical connections shown in FIG. 1(*a*) are such that a substantially regular stepped axial accelerating DC electric field is provided along the length of the fragmentation cell 1 using two programmable DC power supplies DC1 and DC2 and a resistor potential divider network of 1 MΩ resistors. An AC or RF voltage supply provides phase (RF+) and anti-phase (RF−) voltages at a frequency of preferably 1.75 MHz and is coupled to the ion tunnel sections 4*a*,4*b*,4*c* via capacitors which are preferably identical in value (100 pF). According to other embodiments the frequency may be in the range of 0.1–3.0 MHz. Four 10 μH inductors are provided in the DC supply rails to reduce any RF feedback onto the DC supplies. A regular stepped axial DC voltage gradient is provided if all the resistors are of the same value. Similarly, the same AC or RF voltage is supplied to all the electrodes if all the capacitors are the same value. FIG. 4 shows how, in one embodiment, the axial DC potential varies across a 10 cm central portion of the ion tunnel fragmentation cell 1. The inter-segment voltage step in this particular embodiment is −1V. However, according to more preferred embodiments lower voltage steps of e.g. approximately −0.2V may be used. FIG. 5 shows a potential energy surface across several ion tunnel segments 4*b* at a central portion of the ion tunnel fragmentation cell 1. As can be seen, the potential energy profile is such that ions will cascade from one ion tunnel segment to the next.

FIG. 1(*b*) shows another embodiment wherein the ion tunnel fragmentation cell 1 also traps, accumulates or otherwise confines ions within the fragmentation cell 1. In this embodiment, the DC voltage applied to the final ion tunnel segment 4*c* (i.e. that closest and adjacent to the exit aperture 3) is independently controllable and can in one mode of operation be maintained at a relatively high DC blocking or trapping potential (DC3) which is more positive for positively charged ions (and vice versa for negatively charged ions) than the preceding ion tunnel segment(s) 4*b*. Other embodiments are also contemplated wherein other ion tunnel segments 4*a*,4*b* may alternatively and/or additionally be maintained at a relatively high trapping potential. When the final ion tunnel segment 4*c* is being used to trap ions within the fragmentation cell 1, an AC or RF voltage may or may not be applied to the final ion tunnel segment 4*c*.

The DC voltage supplied to the plates forming the entrance and exit apertures 2,3 is also preferably independently controllable and preferably no AC or RF voltage is supplied to these plates. Embodiments are also contemplated wherein a relatively high DC trapping potential may be applied to the plates forming entrance and/or exit aperture 2,3 in addition to or instead of a trapping potential being supplied to one or more ion tunnel segments such as at least the final ion tunnel segment 4*c*.

In order to release ions from confinement within the fragmentation cell 1, the DC trapping potential applied to e.g. the final ion tunnel segment 4*c* or to the plate forming the exit aperture 3 is preferably momentarily dropped or varied, preferably in a pulsed manner. In one embodiment the DC voltage may be dropped to approximately the same DC voltage as is being applied to neighbouring ion tunnel segment(s) 4*b*. Embodiments are also contemplated wherein the voltage may be dropped below that of neighbouring ion tunnel segment(s) so as to help accelerate ions out of the fragmentation cell 1. In another embodiment a V-shaped trapping potential may be applied which is then changed to a linear profile having a negative gradient in order to cause ions to be accelerated out of the fragmentation cell 1. The voltage on the plate forming the exit aperture 3 can also be set to a DC potential such as to cause ions to be accelerated out of the fragmentation cell 1.

Figure 6:
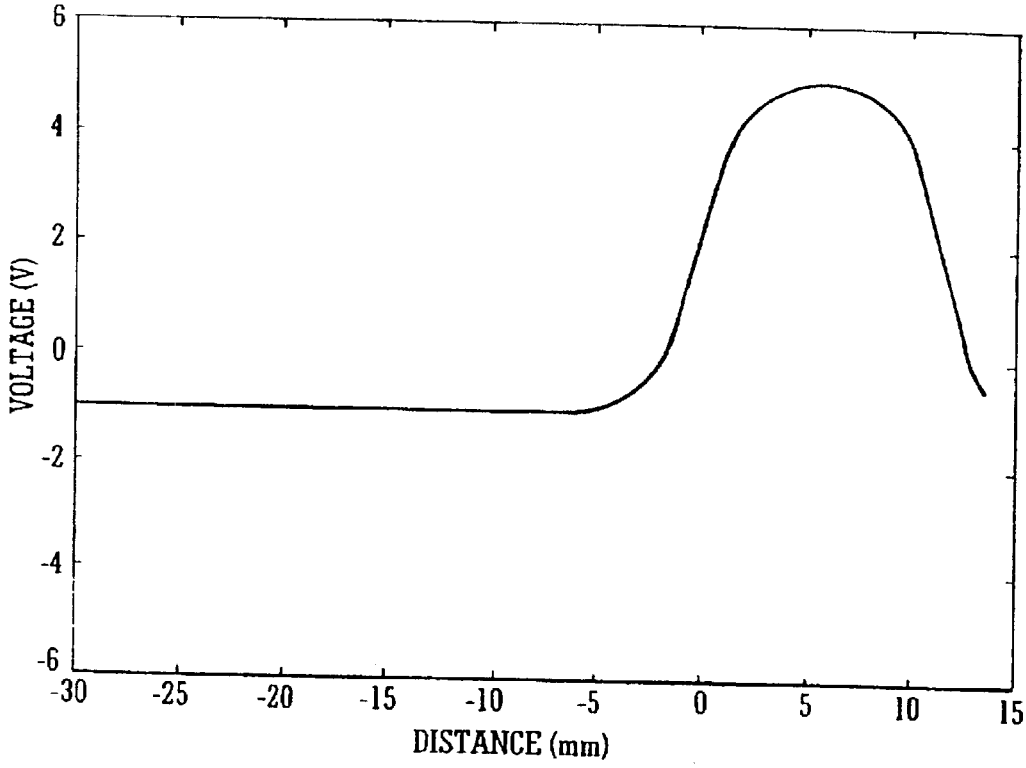
FIG. 6 shows a portion of an axial DC potential profile for a fragmentation cell being operated in an trapping mode without an accelerating axial DC potential gradient being applied along the length of the fragmentation cell.

Other less preferred embodiments are contemplated wherein no axial DC voltage difference or gradient is applied or maintained along the length of the fragmentation cell 1. FIG. 6, for example, shows how the DC potential may vary along a portion of the length of the fragmentation cell 1 when no axial DC field is applied and the fragmentation cell 1 is acting in a trapping or accumulation mode. In this figure, 0 mm corresponds to the midpoint of the gap between the fourteenth 4*b* and fifteenth (and final) 4*c* ion tunnel segments. In this particular example, the blocking potential was set to +5V (for positive ions) and was applied to the last (fifteenth) ion tunnel segment 4*c* only. The preceding fourteen ion tunnel segments 4*a*,4*b* had a potential of −1V applied thereto. The plate forming the entrance aperture 2 was maintained at 0V DC and the plate forming the exit aperture 3 was maintained at −1V.

Figure 7A:
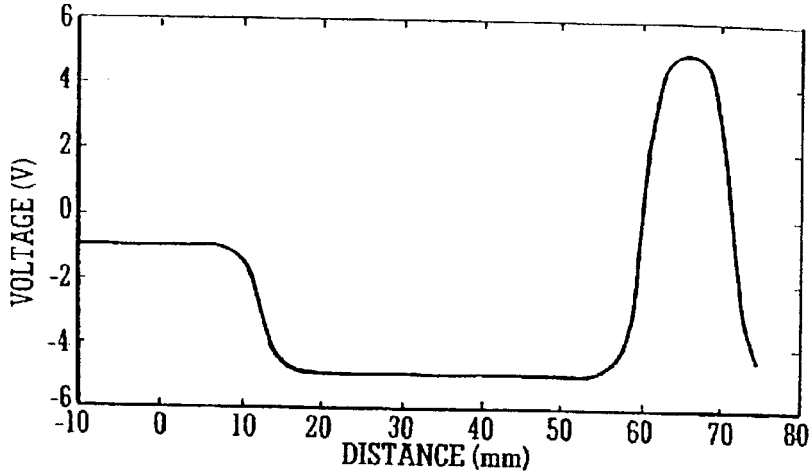
FIG. 7(*a*) shows an axial DC potential profile for a fragmentation cell operated in a "fill" mode of operation.
Figure 7B:
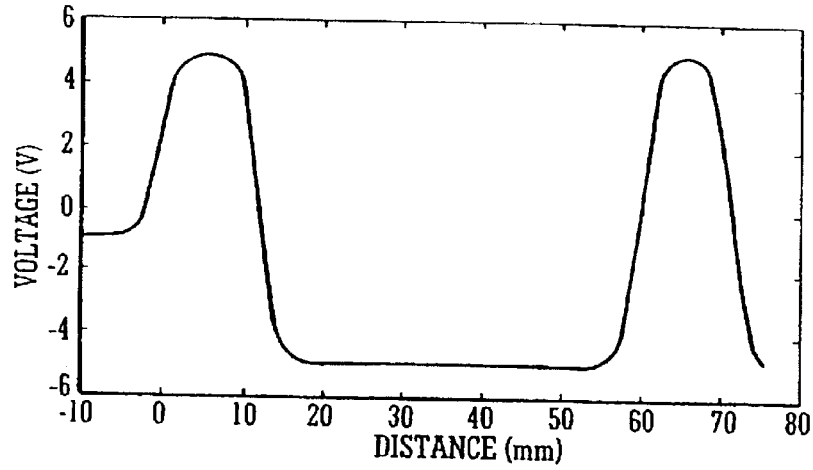
Figure 7C:
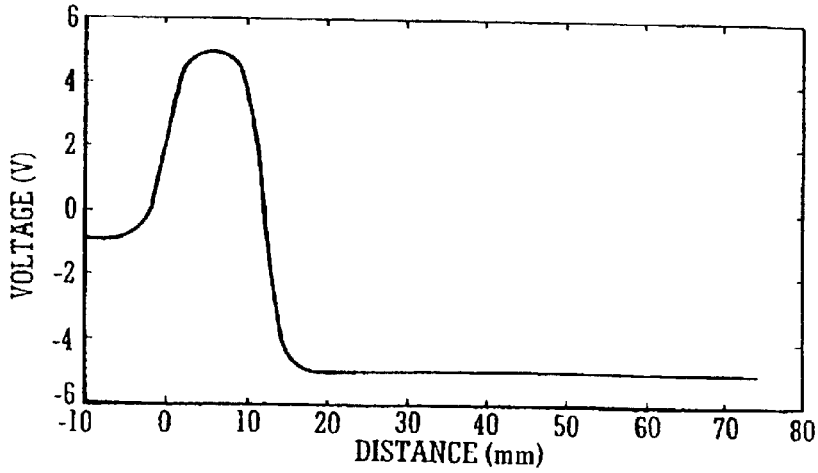

More complex modes of operation are contemplated wherein two or more trapping potentials may be used to isolate one or more section(s) of the ion tunnel fragmentation cell 1. For example, FIG. 7(*a*) shows a portion of the axial DC potential profile for a fragmentation cell 1 according to one embodiment operated in a "fill" mode of operation, FIG. 7(*b*) shows a corresponding "closed" mode of operation, and FIG. 7(*c*) shows a corresponding "empty" mode of operation. By sequencing the potentials, the fragmentation cell 1 may be opened, closed and then emptied in a short defined pulse. In the example shown in the figures, 0 mm corresponds to the midpoint of the gap between the tenth and eleventh ion tunnel segments 4*b*. The first nine segments 4*a*,4*b* are held at −1V, the tenth and fifteenth segments 4*b* act as potential barriers and ions are trapped within the eleventh, twelfth, thirteenth and fourteenth segments 4*b*. The trap segments are held at a higher DC potential (+5V) than the other segments 4*b*. When closed the potential barriers are held at +5V and when open they are held at −1V or −5V. This arrangement allows ions to be continuously accumulated and stored, even during the period when some ions are being released for subsequent mass analysis, since ions are free to continually enter the first nine segments 4*a*,4*b*. A relatively long upstream length of the fragmentation cell 1 may be used for trapping and storing ions and a relatively short downstream length may be used to hold and then release ions. By using a relatively short downstream length, the pulse width of the packet of ions released from the fragmentation cell 1 may be constrained. In other embodiments multiple isolated storage regions may be provided.

Figure 8:
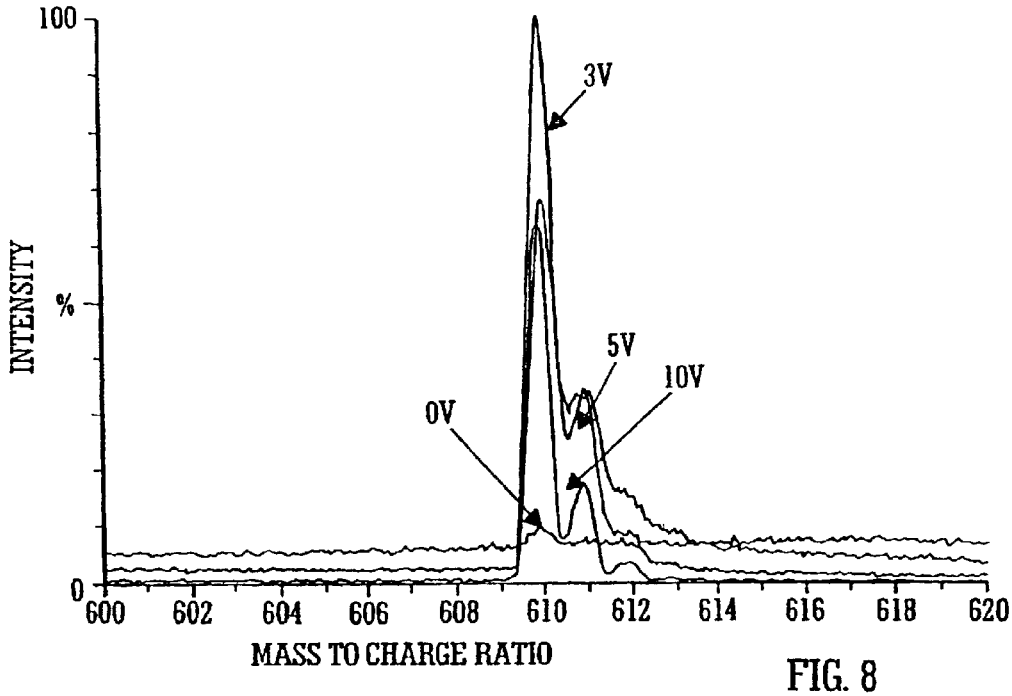
FIG. 8 shows the effect of various applied axial DC voltage gradients on the intensity of daughter ions observed in a parent ion scan.

According to a particularly preferred embodiment, axial DC voltage gradients may additionally be applied along at least a portion of the fragmentation cell 1 so as to enhance the speed of the device. FIG. 8 shows the effect of applying various axial DC voltage differences or gradients along the whole length of the fragmentation cell 1 when performing parent ion scans of reserpine. An upstream quadrupole mass filter Q1 (MS1) was scanned from 600 to 620 amu in a time of 20 ms with an inter-scan delay ("ISD") of 10 ms (during which time the RF voltage applied to the fragmentation cell 1 was momentarily pulsed to zero for 5 ms so as to empty the fragmentation cell 1, and after which the fragmentation cell 1 was allowed to recover for a further 5 ms). The fragmentation cell 1 was set to operate in a fragmentation mode with the fragmentation cell 1 being held at approx. 35V DC below the DC potential at which the ion source is held so that ions are sufficiently energetic when entering the fragmentation cell 1 that they fragment when they collide with collision gas in the fragmentation cell 1. A downstream quadrupole mass filter Q3 (MS2) was set so as to transmit only daughter ions having a mass to charge ratio of 195. The sample used was 50 pg/μl reserpine (having a mass to charge ratio of 609) infused at 5 μl/min. Results are shown for applied axial DC voltage differences of 0V, 3V, 5V and 10V across the length of the whole fragmentation cell 1. The ordinate axis indicates the intensity of daughter ions (having a mass to charge ratio equal to 195) which were observed. As can be seen, when no axial DC voltage difference was maintained hardly any daughter ions were observed exiting the fragmentation cell 1 during the timescale of the scan (20 ms). The daughter ions are still produced in the fragmentation cell 1, but once thermalised they will have relatively low axial velocities and the absence of any axial DC voltage difference means that the daughter ions will tend not to exit the fragmentation cell 1 during the 20 ms that the upstream quadrupole mass filter Q1 (MS1) is being scanned. The greatest intensity of daughter ions was observed when an axial DC voltage difference of 3V was maintained along the whole length of the fragmentation cell 1. For reasons which are not fully understood, when higher axial DC voltage differences of 5V and 10V were maintained, the resulting intensity of daughter ions exiting the fragmentation cell 1 was observed to drop. This may possibly be due to ions becoming defocussed when higher axial DC voltage differences were maintained across the fragmentation cell 1 with the result that some ions, when exiting the fragmentation cell 1, may impinge upon the plate forming the relatively small (2.2 mm) exit aperture 2 and hence be lost.

With conventional multipole collision cells there exists a problem of cross talk in that subsequent acquisitions may contain ions from a previous acquisition. In order to reduce this cross talk it is known to pulse the RF voltage applied to the collision cell to zero for 5 ms in order to clear the collision cell of ions. Thereafter, the collision cell is left for ~30 ms enabling the collision cell to recover, fill up with ions and equilibrate before acquiring the next data point.

In order to maintain a reasonable duty cycle at short acquisition (scan or dwell) times, the recovery time period must also be correspondingly short. However, if the time period allowed for recovery is too short (i.e. <30 ms) then the conventional collision cell does not have enough time to refill with ions with the result that a decrease in signal intensity is observed.

Figure 9:
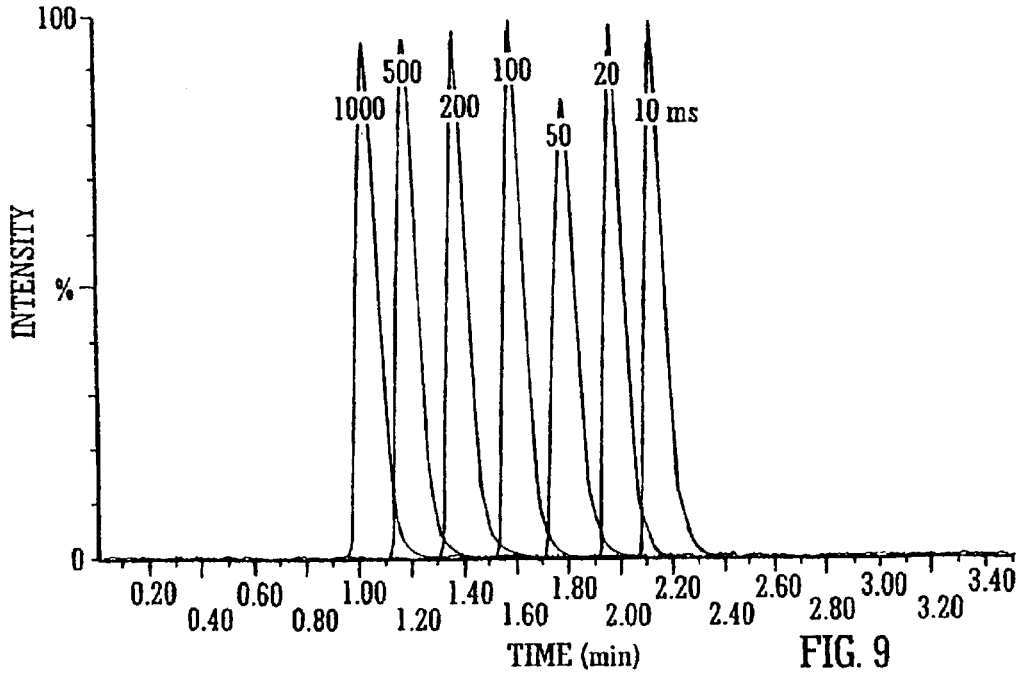
FIG. 9 shows the effect of acquisition time on signal intensity.

FIG. 9 shows the effect of shortening the dwell time when using the preferred ion tunnel collision cell 1 on the intensity of ions observed with 10 μl loop injections of reserpine into 200 μl/min 50% Aqu. MeCN. The interscan delay was set to 10 ms in all cases. The upstream quadrupole Q1 (MS1) was set to transmit ions having a mass to charge ratio of 609 and the downstream quadrupole Q3 (MS2) was fixed to transmit ions having a mass to charge ratio of 195. The fragmentation cell 1 was set to operate in a fragmentation mode (i.e. the fragmentation cell 1 was maintained at a DC bias of 35V relative to the ion source). An axial DC voltage difference of 3V was maintained along the length of the fragmentation cell 1. During the interscan delay the RF voltage was pulsed to zero for 5 ms and then the fragmentation cell 1 was left to recover for 5 ms. The figure shows that for acquisition (dwell) times of 1000 ms down to 10 ms there is negligible effect on the observed intensity.

The fragmentation cell 1 according to the preferred embodiment equilibrates within approx. 3 ms and so has no problem operating at inter-scan delays of 10 ms unlike conventional collision cells without axial voltage gradients which can require an inter-scan delay of up to approx. 35 ms for maximum sensitivity.

Figure 10:
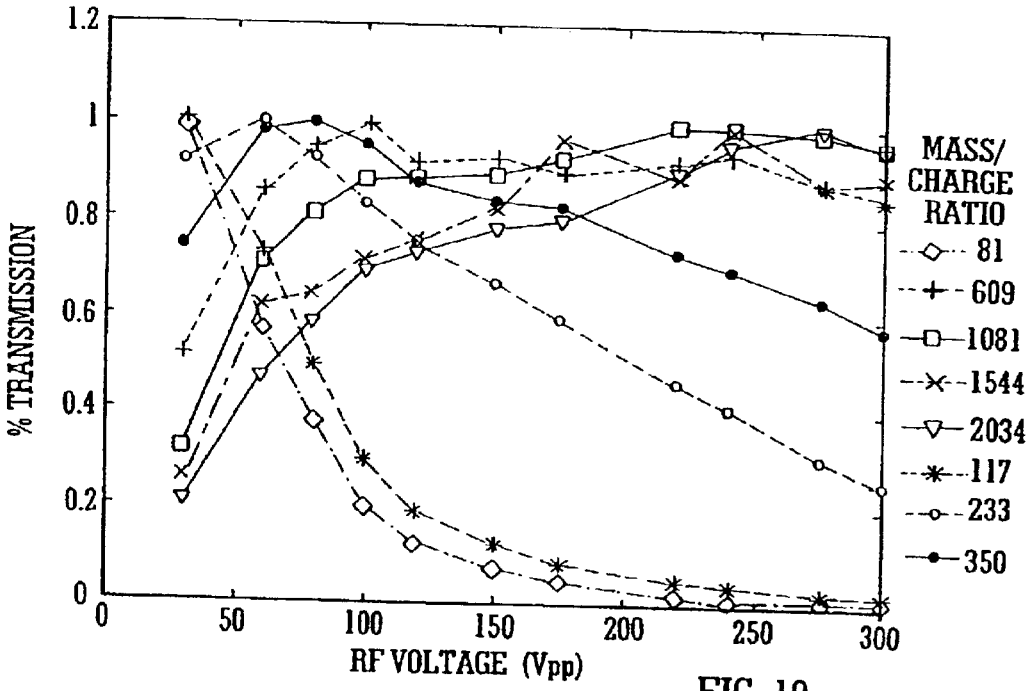
FIG. 10 shows how the transmission of ions varies as a function of mass to charge ratio and the amplitude of the RF voltage in the absence of collision gas in the fragmentation cell.

FIG. 10 shows data relating to the fragmentation cell 1 being operated in a non-fragmenting mode without any collision gas being present in the fragmentation cell 1. The DC bias was equal throughout the fragmentation cell 1 and was set to 3V i.e. no axial DC voltage gradient was maintained. As can be seen, for ions of relatively low mass to charge ratio (e.g. 81 and 117) the amplitude of the RF voltage supply should be relatively low in order for these ions to be efficiently transmitted, whereas for ions of higher mass to charge ratio (e.g. 1081, 1544 and 2034) the amplitude of the RF voltage supply should be relatively high in order for those ions to be efficiently transmitted.

Figure 11:
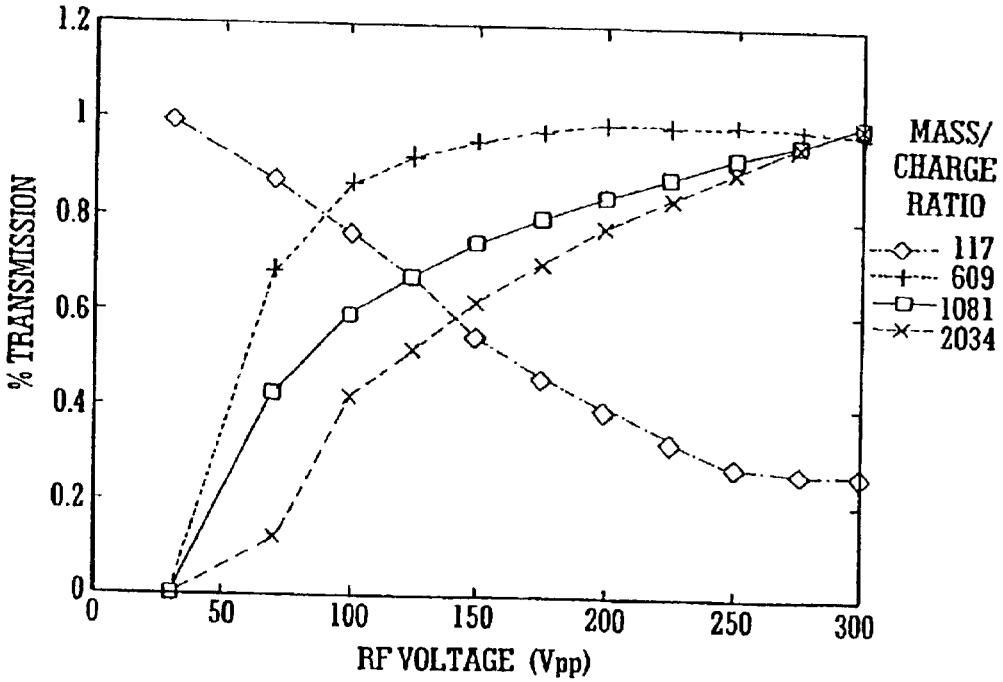
FIG. 11 shows how the transmission of ions varies as a function of mass to charge ratio and the amplitude of the RF voltage with collision gas present in the fragmentation cell but with the fragmentation cell being operated in a non-fragmenting mode.
Figure 12A:
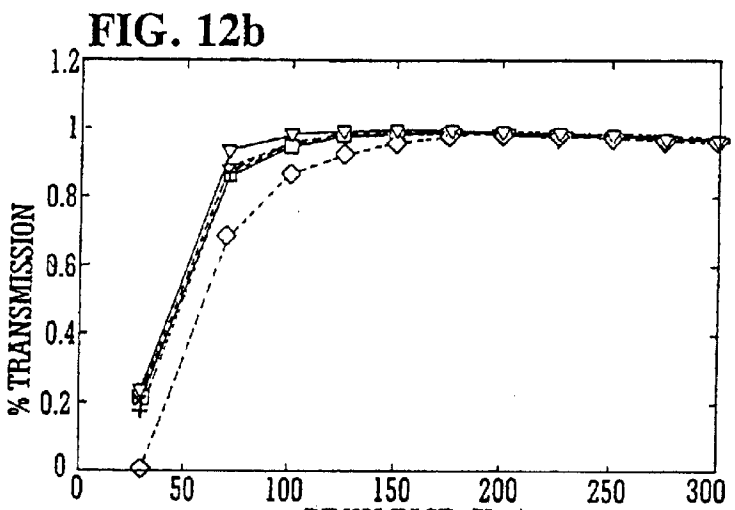
FIG. 12(*a*) shows how the transmission of ions having a mass to charge ratio of 117 varies as a function of applied axial DC voltage gradient and the amplitude of the RF voltage.
Figure 12B:
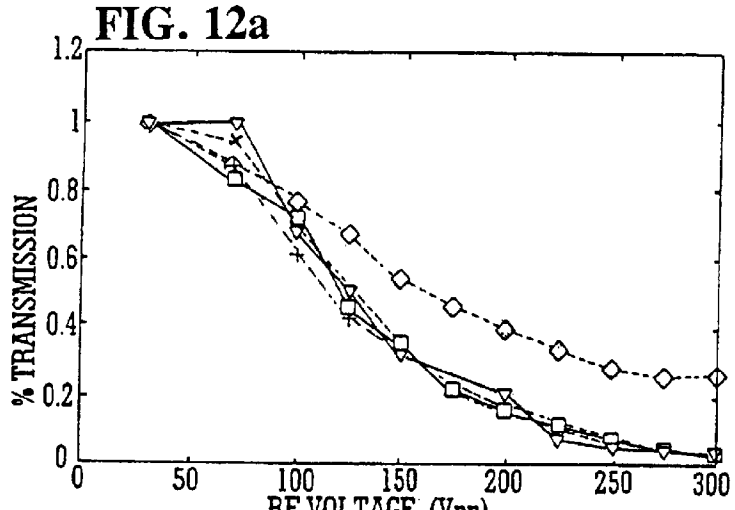
Figure 12C:
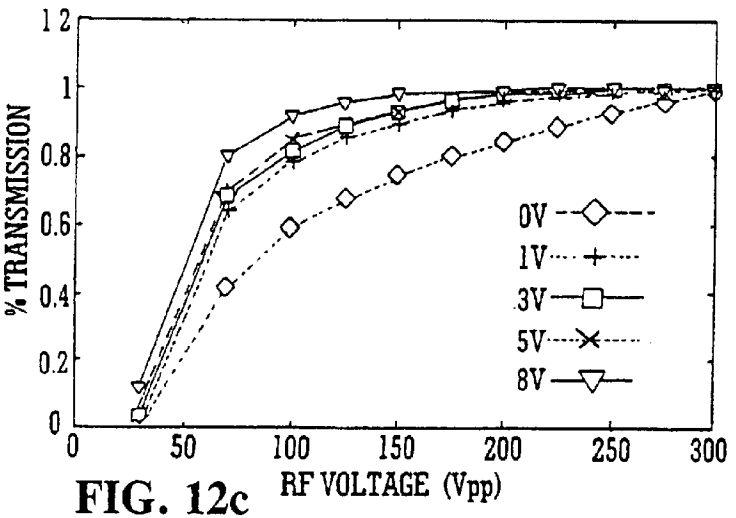
Figure 12D:
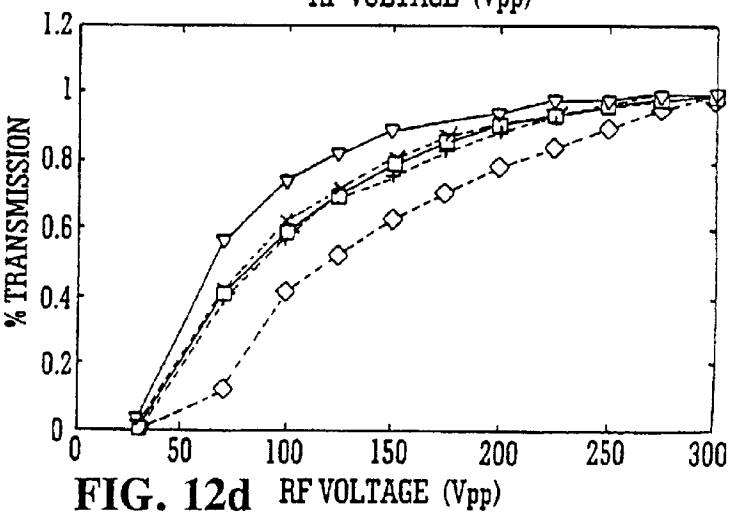

A somewhat similar effect is observed when the fragmentation cell 1 is operated still in a non-fragmentation mode but with collision gas present as can be seen from FIG. 11. The gas pressure was $3\times10^{-3}$ mbar and the DC bias was 0.5 V and equal throughout the fragmentation cell i.e. no axial DC voltage gradient was maintained. However, whereas when no collision gas was present a transmission of approx. 20–30% was observed at low RF amplitudes for relatively high mass to charge ratio ions, when collision gas is present the transmission of relatively high mass to charge ratio ions drops to zero. It is generally observed that in order to observe comparable transmission higher RF voltage amplitudes are required when operating the fragmentation cell 1 with collision gas present compared to when operating the fragmentation cell 1 without collision gas present.

The effect of maintaining various DC voltage gradients across the fragmentation cell 1 on the transmission of ions having various mass to charge ratios is shown in more detail in FIG. 12. The pressure in the fragmentation cell 1 was $3\times10^{-3}$ mbar. The ion tunnel segment closest the entrance aperture 2 was maintained at 0.5 V. The downstream quadrupole Q3 (MS2) was operated in a RF only (i.e. ion-guiding) mode. FIG. 12(*a*) shows the transmission characteristics for ions having a mass to charge ratio of 117, FIG. 12(*b*) for ions having a mass to charge ratio of 609, FIG. 12(*c*) for ions having a mass to charge ratio of 1081, and FIG. 12(*d*) for ions having a mass to charge ratio of 2034. The transmission characteristics show that in order to efficiently transmit ions having relatively low mass to charge ratios (e.g. 117) the amplitude of the RF voltage should be relatively low whereas in order to efficiently transmit ions having relatively high mass to charge ratios (e.g. 2034) the amplitude of the RF voltage should be relatively high. It is apparent therefore than when MS/MS experiments are performed wherein both high and low mass to charge ratio ions must be transmitted, the amplitude of the RF voltage should ideally be set to some intermediate value. According to a preferred embodiment, the amplitude of the RF voltage is linearly ramped from 50 $V_{pp}$ for ions having a mass to charge ratio of 2 up to 320 $V_{pp}$ for ions having a mass to charge ratio of 1000, and for ions having a mass to charge ratio >1000 the amplitude of the RF voltage is preferably maintained at 320 $V_{pp}$.

Figure 13:
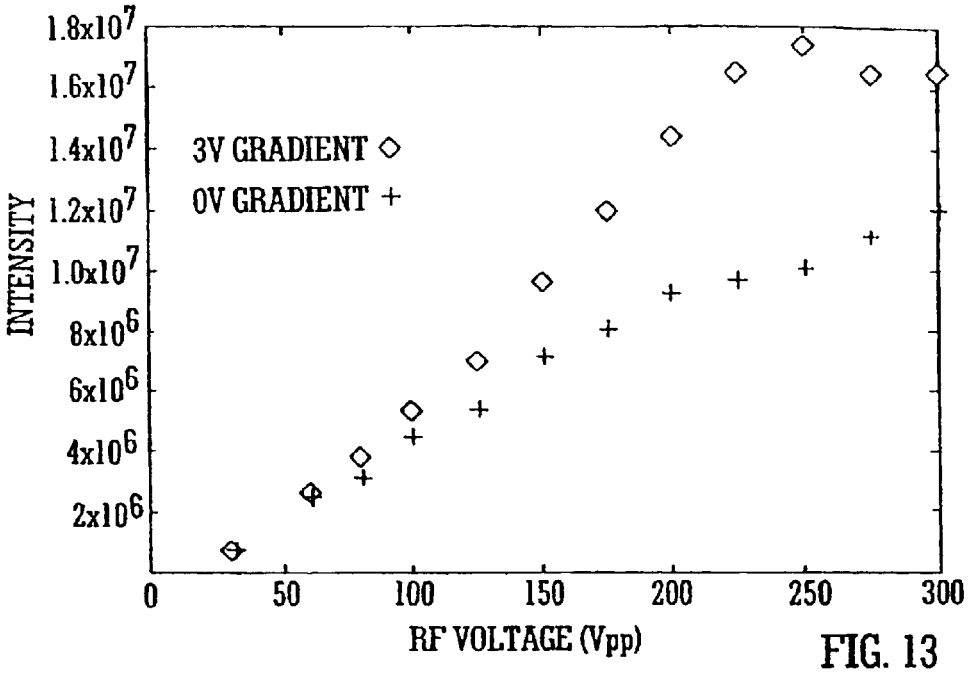
FIG. 13 shows how the transmission of daughter ions having a mass to charge ratio of 173 (resulting from the fragmentation of parent ions having a mass to charge ratio of 2872) varies as a function of the amplitude of the RF voltage when axial DC voltage gradients of 0V and 3V are applied.

FIG. 13 shows the intensity of daughter ions having a mass to charge ratio of 173 produced by fragmenting a high mass cluster from NaRbCsI (having a mass to charge ratio of 2872) in a daughter ion MS/MS experiment as a function of the amplitude of the applied RF voltage with and without a 3V DC voltage difference being maintained along the length of the fragmentation cell 1. This suggests that for MS/MS modes of operation, the amplitude of the RF voltage required for maximum transmission is closer to that of the higher mass to charge ratio parent ion than that of the lower mass to charge ratio daughter ion. Furthermore, it shows that the application of an axial DC voltage gradient improves the intensity of the signal compared with no axial DC voltage gradient. Similar results were obtained using PPG 3000 and also for lower mass parent ions.

Figure 14:
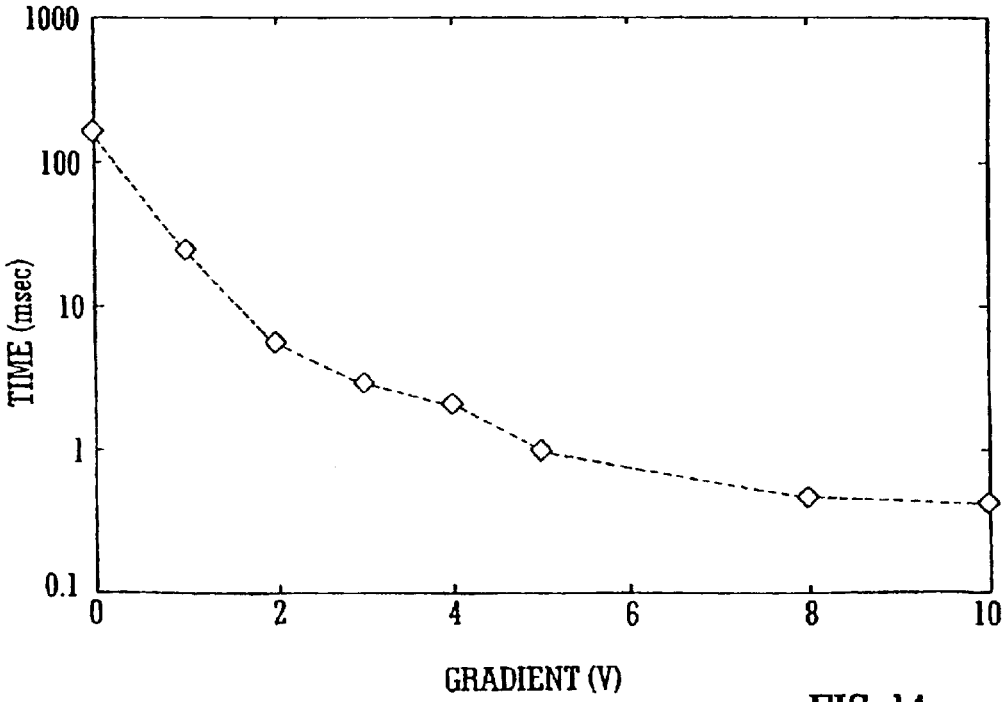
FIG. 14 shows how the empty time of the ion tunnel fragmentation cell varies as a function of applied DC voltage gradient.

One of the reasons for applying a DC voltage gradient across the fragmentation cell 1 is to decrease the transit time of ions travelling through the cell. The transit time was measured using an oscilloscope attached to the detector head amplifier set to trigger off a change in mass program. The time taken for the preferred fragmentation cell 1 to empty as a function of axial DC voltage gradient is shown in FIG. 14. The empty time is reduced from about 150 ms with no applied DC voltage difference to about 400 $\mu$s for a DC voltage difference of 10V across the whole fragmentation cell 1. The pressure in the fragmentation cell was $3\times10^{-3}$ mbar. A conventional hexapole fragmentation cell typically has a 30 ms empty time. It will therefore be appreciated that by applying an axial DC voltage gradient to an ion tunnel fragmentation cell 1 shorter exit times can be obtained compared with those inherent with using a conventional multipole collision cell.

Figure 15A:
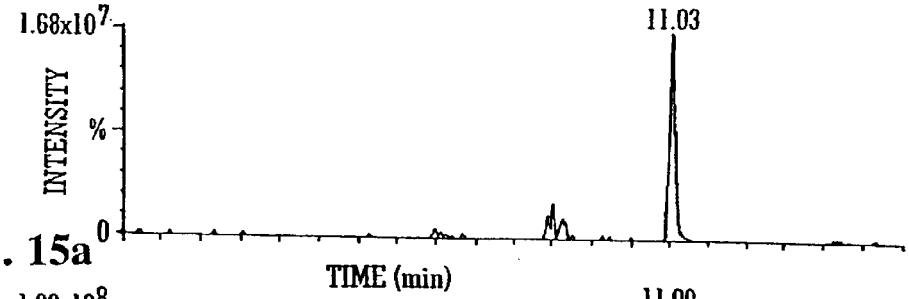
FIG. 15(*a*) shows a neutral loss spectra of S-desmethyl metabolite formed during microsomal incubation of Rabeprazole for a conventional hexapole collision cell.
Figure 15B:
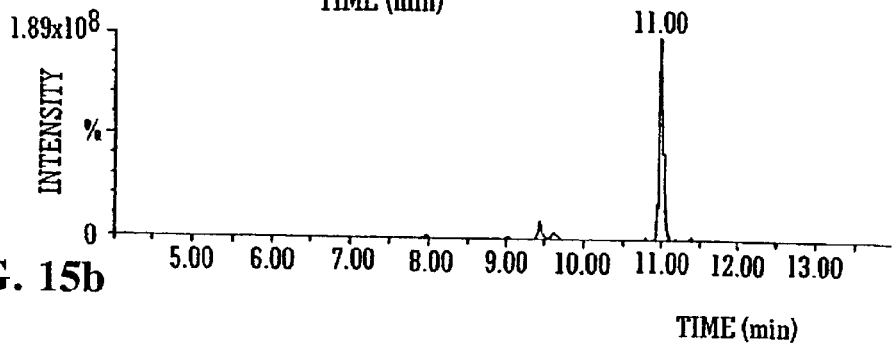

FIG. 15 compares neutral loss spectra obtained using a hexapole fragmentation cell (see FIG. 15(*a*)) with a fragmentation cell 1 according to the preferred embodiment (see FIG. 15(*b*)). The sample was S-desmethyl metabolite formed by human liver microsomal incubation of Rabeprazole for 60 minutes. As is apparent, the sensitivity has improved by a factor of approximately ×10 when using the fragmentation cell 1 according to the preferred embodiment.

Figure 16A:
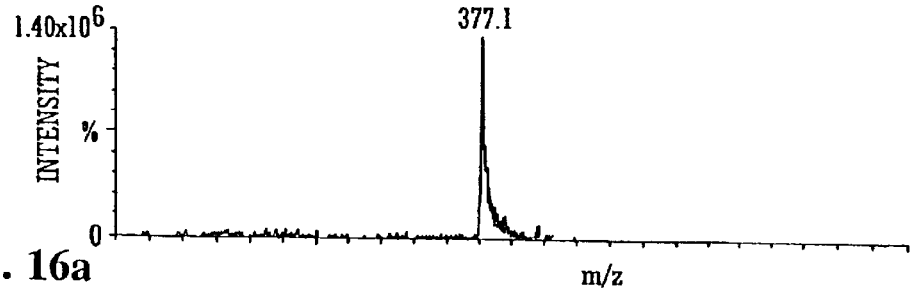
FIG. 16(*a*) shows a parent ion spectra of Sulphone metabolite formed during microsomal incubation of Rabeprazole for a conventional hexapole collision cell.
Figure 16B:
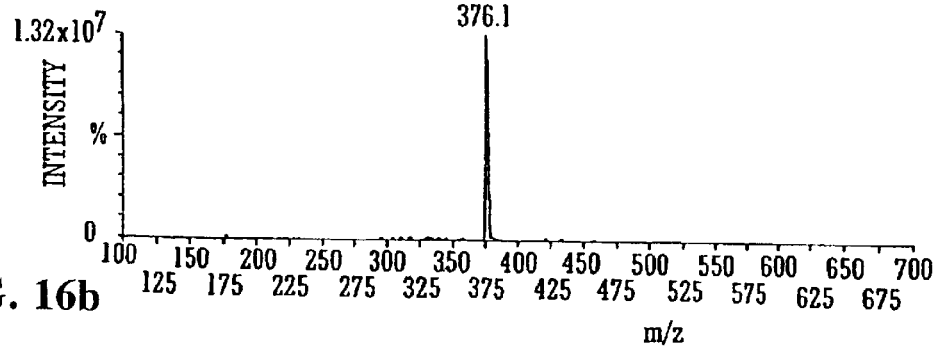

FIG. 16 compares parent ion spectra obtained using a conventional hexapole fragmentation cell (see FIG. 16(*a*)) and a fragmentation cell 1 according to the preferred embodiment (see FIG. 16(*b*)). The sample was a Sulphone metabolite formed by human liver microsomal incubation of Rabeprazole. The sensitivity has increased by a factor ×10 and also the resolution has greatly improved from over 25 amu to unit base resolution. The ion tunnel fragmentation cell 1 according to the preferred embodiment therefore enables more sensitive and higher resolution mass spectra to be obtained.

Figure 17A:
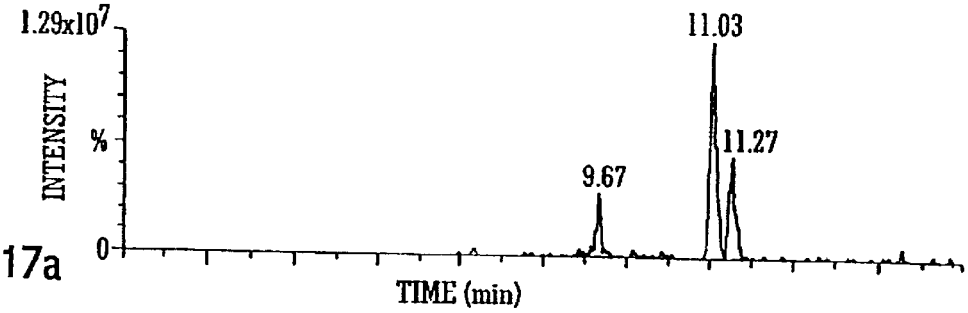
FIG. 17(*a*) shows extracted ion chromatograms of Sulphone metabolite formed during microsomal incubation of Rabeprazole for a conventional hexapole collision cell.
Figure 17B:
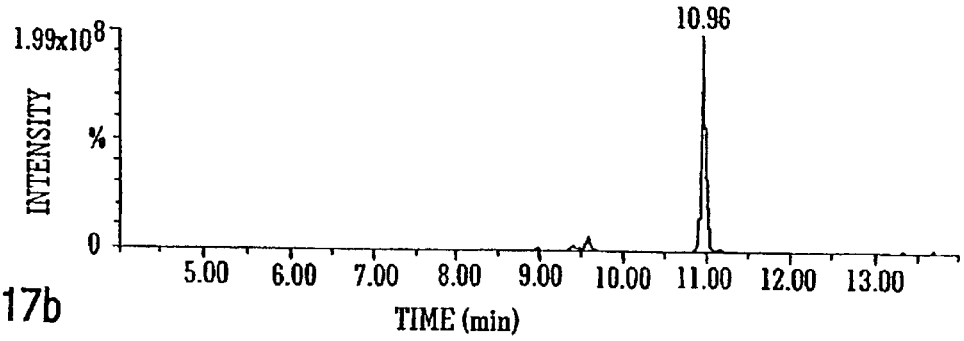

Advantageously, due to the increased resolution obtained using the fragmentation cell 1 according to the preferred embodiment, extracted ion chromatograms can be obtained which are substantially free of misleading interference peaks. This significantly aids the identification of the metabolite peaks since spurious peaks are no longer (falsely) considered when seeking to identify the sample on the basis of the extended ion chromatograms. FIG. 17 shows extracted ion chromatograms of Sulphone metabolite formed during microsomal incubation of Rabeprazole for 60 minutes. FIG. 17(*a*) shows the results obtained with a conventional hexapole fragmentation cell, and FIG. 17(*b*) shows the results obtained using a fragmentation cell 1 according to the preferred embodiment. As can be seen from comparing the two figures, in addition to recognising a true peak at around 11 minutes, false interference peaks were also recorded at 9.67 minutes and 11.27 minutes when a conventional hexapole collision cell was used. However, the two erroneous peaks were a result of the relatively poor resolution which is inherent when using a conventional hexapole fragmentation cell, and advantageously the erroneous peaks are not observed in the ion chromatogram obtained using the fragmentation cell 1 according to the preferred embodiment as can be seen from FIG. 17(*b*).

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising:

a fragmentation cell in which ions are fragmented in use, said fragmentation cell comprising a plurality of electrodes having apertures through which ions are transmitted in use, wherein at least some of said electrodes are connected to both a DC and an AC or RF voltage supply and wherein an axial DC voltage gradient is maintained in use along at least a portion of the length of said fragmentation cell.

2. A mass spectrometer as claimed in claim 1, wherein said fragmentation cell comprises a plurality of segments, each segment comprising a plurality of electrodes having apertures through which ions are transmitted and wherein all the electrodes in a segment are maintained at substantially the same DC potential and wherein adjacent electrodes in a segment are supplied with different phases of an AC or RF voltage.

3. A mass spectrometer as claimed in claim 1, wherein ions are arranged to be trapped within said fragmentation cell in a mode of operation.

4. A mass spectrometer as claimed in claim 1, wherein said fragmentation cell consists of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; and (xv) >150 electrodes.

5. A mass spectrometer as claimed in claim 1, wherein the diameter of the apertures of at least 50% of the electrodes forming said fragmentation cell is selected from the group consisting of: (i) ≦10 mm; (ii) ≦9 mm; (iii) ≦8 mm; (iv) ≦7 mm; (v) ≦6 mm; (vi) ≦5 mm; (vii) ≦4 mm; (viii) ≦3 mm; (ix) ≦2 mm; and (x) ≦1 mm.

6. A mass spectrometer as claimed in claim 1, wherein said fragmentation cell is maintained, in use, at a pressure selected from the group consisting of: (i) $>1.0\times10^{-3}$ mbar; (ii) $>5.0\times10^{-3}$ mbar; (iii) $>1.0\times10^{-2}$ mbar; (iv) $10^{-3}$–$10^{-2}$ mbar; and (v) $10^{-4}$–$10^{-1}$ mbar.

7. A mass spectrometer as claimed in claim 1, wherein at least 50%, 60%, 70%, 80%, 90% or 95% of the electrodes forming the fragmentation cell have apertures which are substantially the same size or area.

8. A mass spectrometer as claimed in claim 1, wherein the thickness of at least 50% of the electrodes forming said fragmentation cell is selected from the group consisting of: (i) ≦3 mm; (ii) ≦2.5 mm; (iii) ≦2.0 mm; (iv) ≦1.5 mm; (v) ≦1.0 mm; and (vi) ≦0.5 mm.

9. A mass spectrometer as claimed in claim 1, further comprising an ion source selected from the group consisting of: (i) Electrospray ("ESI") ion source; (ii) Atmospheric Pressure Chemical Ionisation ("APCI") ion source; (iii) Atmospheric Pressure Photo Ionisation ("APPI") ion source; (iv) Matrix Assisted Laser Desorption Ionisation ("MALDI") ion source; (v) Laser Desorption Ionisation ion source; (vi) Inductively Coupled Plasma ("ICP") ion source; (vii) Electron Impact ("EI) ion source; and (viii) Chemical Ionisation ion source.

10. A mass spectrometer as claimed in claim 1, wherein at least 10%, 20%, 30%, 40%, 50%, 60%, 70%, 80%, 90%, or 95% of said electrodes are connected to both a DC and an AC or RF voltage supply.

11. A mass spectrometer as claimed in claim 1, wherein said fragmentation cell comprising a housing having an upstream opening for allowing ions to enter said fragmentation cell and a downstream opening for allowing ions to exit said fragmentation cell.

12. A mass spectrometer as claimed in claim 1, wherein said fragmentation cell has a length selected from the group consisting of: (i) <5 cm; (ii) 5–10 cm; (iii) 10–15 cm; (iv) 15–20 cm; (v) 20–25 cm; (vi) 25–30 cm; and (vii) >30 cm.

13. Amass spectrometer as claimed in claim 1, wherein the axial DC voltage difference maintained along a portion of said fragmentation cell is selected from the group consisting of: (i) 0.1–0.5 V; (ii) 0.5–1.0 V; (iii) 1.0–1.5 V; (iv) 1.5–2.0 V; (v) 2.0–2.5 V; (vi) 2.5–3.0 V; (vii) 3.0–3.5 V; (viii) 3.5–4.0 V; (ix) 4.0–4.5 V; (x) 4.5–5.0 V; (xi) 5.0–5.5 V; (xii) 5.5–6.0 V; (xiii) 6.0–6.5 V; (xiv) 6.5–7.0 V; (xv) 7.0–7.5 V; (xvi) 7.5–8.0 V; (xvii) 8.0–8.5 V; (xviii) 8.5–9.0 V; (xix) 9.0–9.5 V; (xx) 9.5–10.0 V; and (xxi) >10V.

14. A mass spectrometer as claimed in claim 1, wherein an axial DC voltage gradient is maintained along at least a portion of said fragmentation cell selected from the group consisting of: (i) 0.01–0.05 V/cm; (ii) 0.05–0.10 V/cm; (iii) 0.10–0.15 V/cm; (iv) 0.15–0.20 V/cm; (v) 0.20–0.25 V/cm; (vi) 0.25–0.30 V/cm; (vii) 0.30–0.35 V/cm; (viii) 0.35–0.40 V/cm; (ix) 0.40–0.45 V/cm; (x) 0.45–0.50 V/cm; (xi) 0.50–0.60 V/cm; (xii) 0.60–0.70 V/cm; (xiii) 0.70–0.80 V/cm; (xiv) 0.80–0.90 V/cm; (xv) 0.90–1.0 V/cm; (xvi) 1.0–1.5 V/cm; (xvii) 1.5–2.0 V/cm; (xviii) 2.0–2.5 V/cm; (xix) 2.5–3.0 V/cm; and (xx) >3.0 V/cm.

15. A mass spectrometer comprising:

an ion source;

one or more ion guides;

a first quadrupole mass filter;

a fragmentation cell for fragmenting ions, said fragmentation cell comprising a plurality of electrodes having apertures through which ions are transmitted in use, wherein at least some of said electrodes are connected to both a DC and an AC or RF voltage supply and wherein an axial DC voltage gradient is maintained in use along at least a portion of the length of said fragmentation cell;

a second quadrupole mass filter; and a detector.

16. A mass spectrometer comprising:

an ion source;

one or more ion guides;

a quadrupole mass filter;

a fragmentation cell for fragmenting ions, said fragmentation cell comprising a plurality of electrodes having apertures through which ions are transmitted in use, wherein at least some of said electrodes are connected to both a DC and an AC or RF voltage supply and wherein an axial DC voltage gradient is maintained in use along at least a portion of the length of said fragmentation cell; and a time of flight mass analyser.

17. A mass spectrometer as claimed in claim 16, wherein said fragmentation cell comprises a plurality of segments, each segment comprising a plurality of electrodes having apertures through which ions are transmitted and wherein all the electrodes in a segment are maintained at substantially the same DC potential and wherein adjacent electrodes are supplied with different phases of an AC or RF voltage.

18. A mass spectrometer as claimed in claim 16, wherein said one or more ion guides comprise one or more AC or RF only ion tunnel ion guides.

19. A mass spectrometer as claimed in claim 16, wherein said one or more ion guides comprise one or more hexapole ion guides.

20. A mass spectrometer comprising:

a first mass filter/analyser;

a fragmentation cell for fragmenting ions, said fragmentation cell being arranged downstream of said first mass filter/analyser and comprising at least 20 electrodes having apertures through which ions are transmitted in use, wherein at least 75% of said electrodes are connected to both a DC and an AC or RF voltage supply and wherein a non-zero axial DC voltage gradient is maintained in use along at least 75% of the length of said fragmentation cell; and a second mass filter/analyser arranged downstream of said fragmentation cell.

21. A mass spectrometer as claimed in claim 20, wherein said first mass filter/analyser comprises a quadruople mass filter/analyser and said second mass filter comprises a quadrupole mass filter/analyser or a time of flight mass analyser.

22. A mass spectrometer comprising:

a fragmentation cell comprising ≧10 ring or plate electrodes having substantially similar internal apertures between 2–10 mm in diameter arranged in a housing having a collision gas inlet port, wherein a collision gas is introduced in use into said fragmentation cell at a pressure of $10^{-4}$–$10^{-1}$ mbar and wherein a DC potential gradient is maintained, in use, along the length of the fragmentation cell.

23. A mass spectrometer as claimed in claim 22, further comprising an ion source and ion optics upstream of said fragmentation cell, wherein said ion source and/or said ion optics are maintained at potentials such that at least some of the ions entering said fragmentation cell have, in use, an energy ≧10 eV for a singly charged ion such that they are caused to fragment.

24. A mass spectrometer comprising:

an ion source;

a fragmentation cell for fragmenting ions, said fragmentation cell comprising at least ten plate-like electrodes arranged substantially perpendicular to the longitudinal axis of said fragmentation cell, each said electrode having an aperture therein through which ions are transmitted in use, said fragmentation cell being supplied in use with a collision gas at a pressure ≧$10^{-3}$ mbar, wherein adjacent electrodes are connected to different phases of an AC or RF voltage supply and a DC potential gradient ≧0.01 V/cm is maintained over at least 20% of the length of said fragmentation cell; and ion optics arranged between the ion source and the fragmentation cell;

wherein in a mode of operation the ion source, ion optics and fragmentation cell are maintained at potentials such that singly charged ions are caused to have an energy ≧10 eV upon entering said fragmentation cell so that at least some of said ions fragment into daughter ions.

25. A mass spectrometer comprising:

a fragmentation cell comprising at least three segments, each segment comprising at least four electrodes having substantially similar sized apertures through which ions are transmitted in use;

wherein in a mode of operation:

electrodes in a first segment are maintained at substantially the same first DC potential but adjacent electrodes are supplied with different phases of an AC or RE voltage supply;

electrodes in a second segment are maintained at substantially the same second DC potential but adjacent electrodes are supplied with different phases of an AC or RF voltage supply;

electrodes in a third segment are maintained at substantially the same third DC potential but adjacent electrodes are supplied with different phases of an AC or RF voltage supply;

wherein said first, second and third DC potentials are all different.

26. A mass spectrometer comprising:

a fragmentation cell in which ions are fragmented in use, said fragmentation cell comprising a plurality of electrodes having apertures through which ions are transmitted in use, wherein at least some of said electrodes are connected to an AC or RF voltage supply.

27. A mass spectrometer as claimed in claim 26, wherein at least some of said electrodes are also connected to a DC voltage supply and wherein an axial DC voltage gradient is maintained in use along at least a portion of the length of said fragmentation cell.

28. A mass spectrometer comprising:

a fragmentation cell in which ions are fragmented in use, said fragmentation cell comprising a plurality of electrodes having apertures through which ions are transmitted in use, wherein in a mode of operation at least a portion of the fragmentation cell is maintained at a DC potential so as to prevent ions from exiting the fragmentation cell.

29. A mass spectrometer comprising:

a fragmentation cell in which ions are fragmented in use, said fragmentation cell comprising a plurality of electrodes having apertures through which ions are transmitted in use, wherein the transit time of ions through the fragmentation cell is selected from the group comprising: (i) ≦0.5 ms; (ii) ≦1.0 ms; (iii) ≦5 ms; (iv) ≦10 ms; (v) ≦20 ms; (vi) 0.01–0.5 ms; (vii) 0.5–1 ms; (viii) 1–5 ms; (ix) 5–10 ms; and (x) 10–20 ms.

30. A mass spectrometer comprising:

a fragmentation cell in which ions are fragmented in use, said fragmentation cell comprising a plurality of electrodes having apertures through which ions are transmitted in use, and wherein in a mode of operation trapping DC voltages are supplied to some of said electrodes so that ions are confined in two or more axial DC potential wells.

31. A mass spectrometer comprising:

a fragmentation cell in which ions are fragmented in use, said fragmentation cell comprising a plurality of electrodes having apertures through which ions are transmitted in use, and wherein in a mode of operation a V-shaped, sinusoidal, curved, stepped or linear axial DC potential profile is maintained along at least a portion of said fragmentation cell.

32. A mass spectrometer comprising:

a fragmentation cell in which ions are fragmented in use, said fragmentation cell comprising a plurality of electrodes having apertures through which ions are transmitted in use, and wherein in a mode of operation an upstream portion of the fragmentation cell continues to receive ions into the fragmentation cell whilst a downstream portion of the fragmentation cell separated from the upstream portion by a potential barrier stores and periodically releases ions.

33. A mass spectrometer as claimed in claim 32, wherein said upstream portion of the fragmentation cell has a length which is at least 10%, 20%, 30%, 40%, 50%, 60%, 70%, 80%, or 90% of the total length of the fragmentation cell.

34. A mass spectrometer as claimed in claim 32, wherein said downstream portion of the fragmentation cell has a length which is less than or equal to 10%, 20%, 30%, 40%, 50%, 60%, 70%, 80%, or 90% of the total length of the fragmentation cell.

35. A mass spectrometer as claimed in claim 32, wherein the downstream portion of the fragmentation cell is shorter than the upstream portion of the fragmentation cell.

36. A mass spectrometer comprising:

a fragmentation cell in which ions are fragmented in use, said fragmentation cell comprising a plurality of electrodes having apertures through which ions are transmitted in use, and wherein in a mode of operation an AC or RF voltage is applied to at least some of said electrodes and the peak amplitude of said AC or RF voltage is varied.

37. A mass spectrometer as claimed in claim 36, wherein the peak amplitude of said AC or RF voltage is increased in time.

38. A mass spectrometer as claimed in claim 36, wherein when ions having a mass to charge ratio <500, <400, <300, <200, <100, or <50 are admitted into said fragmentation cell the peak amplitude of said AC or RF voltage is ≦200 $_{Vpp}$, 150 $V_{Pp}$, 100 $V_{Pp}$, or 60 $V_{Pp}$.

39. A mass spectrometer as claimed in claim 36, wherein when ions having a mass to charge ratio >500, >600, >700, >800, >900, or >1000 are admitted into said fragmentation cell the peak amplitude of said AC or RF voltage is ≧100 $V_{Pp}$, ≧150 $V_{Pp}$, ≧200 $V_{Pp}$, ≧250 $V_{Pp}$, or ≧300 $V_{Pp}$.

40. A method of mass spectrometry, comprising:

fragmenting ions in a fragmentation cell, said fragmentation cell comprising a plurality of electrodes having apertures through which ions are transmitted in use, wherein at least some of said electrodes are connected to both a DC and an AC or RF voltage supply and wherein an axial DC voltage gradient is maintained in use along at least a portion of the length of said fragmentation cell.

* * * * *